US010476139B2

(12) United States Patent
Park et al.

(10) Patent No.: US 10,476,139 B2
(45) Date of Patent: Nov. 12, 2019

(54) ELECTRONIC DEVICE

(71) Applicant: LG ELECTRONICS INC., Seoul (KR)

(72) Inventors: Yunsang Park, Seoul (KR); Hanphil Rhyu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/383,860

(22) Filed: Dec. 19, 2016

(65) Prior Publication Data

US 2017/0179580 A1 Jun. 22, 2017

(30) Foreign Application Priority Data

Dec. 22, 2015 (KR) ..... 10-2015-0184215

(51) Int. Cl.

| | |
|---|---|
| ***H01Q 1/27*** | (2006.01) |
| ***H01Q 5/30*** | (2015.01) |
| ***H01Q 1/24*** | (2006.01) |
| ***H01Q 1/52*** | (2006.01) |
| ***H01Q 3/24*** | (2006.01) |
| ***H01Q 9/04*** | (2006.01) |
| ***H01Q 1/36*** | (2006.01) |
| ***H01Q 1/38*** | (2006.01) |
| ***H01Q 7/00*** | (2006.01) |
| ***H01Q 9/28*** | (2006.01) |

(Continued)

(52) U.S. Cl.

CPC ..... *H01Q 1/273* (2013.01); *H01Q 1/243* (2013.01); *H01Q 1/36* (2013.01); *H01Q 1/38* (2013.01); *H01Q 1/525* (2013.01); *H01Q 3/24* (2013.01); *H01Q 5/30* (2015.01); *H01Q 5/371* (2015.01); *H01Q 7/00* (2013.01); *H01Q 9/0414* (2013.01); *H01Q 9/28* (2013.01); *H01Q 9/42* (2013.01)

(58) Field of Classification Search

CPC ..... H01Q 1/273

See application file for complete search history.

(56) References Cited

U.S. PATENT DOCUMENTS 5,499,398 A 3/1996 Kudoh et al.
5,986,566 A * 11/1999 Yamamori ..... H01Q 1/273 340/7.63

(Continued)

FOREIGN PATENT DOCUMENTS

CN 204462670 U 7/2015
JP 2004-274729 A 9/2004

(Continued)

*Primary Examiner* — Daniel Munoz
(74) *Attorney, Agent, or Firm* — Dentons US LLP

(57) ABSTRACT

An electronic device is disclosed. The electronic device includes a main body on which a controller is mounted, a strap pin connector protruding from the main body, at least a portion of the strap pin connector having conductivity, a strap pin spaced apart from the main body and connected to the strap pin connector, at least a portion of the strap pin having conductivity, and an antenna pattern disposed in an insulating portion of an outer surface of the main body, connected to a wireless communication unit, and having conductivity. The strap pin connector, the strap pin, and the antenna pattern are electrically connected to one another and form an antenna that transmits and receives a radio wave.

15 Claims, 28 Drawing Sheets

(51) Int. Cl.
*H01Q 9/42* (2006.01)
*H01Q 5/371* (2015.01)

(56) References Cited

U.S. PATENT DOCUMENTS

| | | | | |
|---|---|---|---|---|
| 9,070,969 | B2 | 6/2015 | Mow et al. | |
| 2011/0012796 | A1 | 1/2011 | Kim et al. | |
| 2013/0016016 | A1 | 1/2013 | Lin et al. | |
| 2014/0055309 | A1 | 2/2014 | Jenwatanavet | |
| 2014/0362544 | A1* | 12/2014 | Han | G04G 17/06 361/749 |
| 2015/0378321 | A1* | 12/2015 | Fraser | G04G 21/04 368/10 |
| 2016/0118709 | A1* | 4/2016 | Ganswindt | H01Q 1/22 343/718 |
| 2016/0141746 | A1* | 5/2016 | Kim | H01Q 1/273 343/718 |

FOREIGN PATENT DOCUMENTS

| | | | |
|---|---|---|---|
| KR | 106067318 | B1 | 7/2006 |
| KR | 10-2009-0062937 | A | 6/2009 |
| KR | 1020110006999 | A | 1/2011 |
| KR | 1020140139305 | A | 12/2014 |
| KR | 1020150045746 | A | 4/2015 |
| KR | 1020150061454 | A | 6/2015 |
| WO | 2015027934 | A1 | 3/2015 |

* cited by examiner

ELECTRONIC DEVICE

This application claims the benefit of Korean Patent Application No. 10-2015-0184215 filed on Dec. 22, 2015, the entire contents of which are incorporated herein by reference for all purposes as if fully set forth herein.

BACKGROUND OF THE INVENTION

Field of the Invention

The present disclosure relates to a watch electronic device enabling transmission and reception of communication by disposing a main antenna at a main body even when a watch strap is replaced.

Discussion of the Related Art

Terminals may be generally classified into mobile/portable terminals and stationary terminals based on a mobility. The mobile terminals may also be classified into handheld terminals and vehicle mounted terminals depending on whether or not a user can directly carry the terminal.

Mobile terminals have increasingly more functions. Examples of the functions include data and voice communications, capturing images and video using a camera, recording audio, playing music files using a speaker system, and displaying images and video on a display. Some mobile terminals include additional functionality which supports game playing, while other terminals are configured as multimedia players. More recently, the mobile terminals have been configured to receive broadcast and multicast signals which permit viewing of content such as videos and television programs.

As the mobile terminals have increasingly more functions, the mobile terminals have been implemented as multimedia players of multiple functions having capturing images and video, playing music files or video, game playing, receiving broadcast, etc.

Efforts are ongoing to support and increase the functionality of mobile terminals. Such efforts include software and hardware improvements, as well as changes and improvements in the structural components.

A study on wearable electronic devices the user wears is being recently carried out. For example, an attempt has been made to study glass wearable electronic devices, watch wearable electronic devices, etc.

Because the wearable electronic device has to arrange necessary electronic components in a limited space while satisfying design requirements, a need for an optimum design of the wearable electronic device is increasing.

SUMMARY OF THE INVENTION

Accordingly, an object of the present disclosure is to address the above-described and other problems.

Another aspect of the present disclosure is to provide an electronic device enabling transmission and reception of communication by disposing a main antenna at a main body even when a watch strap is replaced.

In one aspect, there is provided an electronic device including a main body on which a controller is mounted; a strap pin connector protruding from the main body, at least a portion of the strap pin connector having conductivity; a strap pin spaced apart from the main body and connected to the strap pin connector, at least a portion of the strap pin having conductivity; and an antenna pattern formed in an insulating portion of an outer surface of the main body, connected to a wireless communication unit, and having conductivity, wherein the strap pin connector, the strap pin, and the antenna pattern are electrically connected to one another and form an antenna that transmits and receives a radio wave.

The main body may include an upper surface including a display unit, a lower surface positioned opposite the upper surface and spaced apart from the upper surface, and a side surface connecting the upper surface to the lower surface. The upper surface, the lower surface, and the side surface may form a space inside the main body. At least a portion of the antenna pattern may be formed in at least one of an insulating portion of the upper surface, an insulating portion of the lower surface, an insulating portion of the side surface, and an insulating portion of the strap pin connector.

The antenna pattern may include a first antenna pattern portion electrically connected to the wireless communication unit, and a second antenna pattern portion spaced apart from the first antenna pattern portion. An end of the second antenna pattern portion may be electrically connected to the first antenna pattern portion.

The main body may include an upper surface including a display unit, a lower surface positioned opposite the upper surface and spaced apart from the upper surface, and a side surface connecting the upper surface to the lower surface. The upper surface, the lower surface, and the side surface may form a space inside the main body. The antenna pattern may be formed in an insulating portion of the side surface. The first antenna pattern portion may be disposed at one of a first location, at which a distance between the first antenna pattern portion and the lower surface is shorter than a distance between the second antenna pattern portion and the lower surface, and a second location, at which a distance between the first antenna pattern portion and the lower surface is longer than a distance between the second antenna pattern portion and the lower surface.

The strap pin connector may include a plurality of strap pin connectors. First and second strap pin connectors of the plurality of strap pin connectors may be electrically connected to the strap pin and are spaced apart from each other. The antenna pattern may include a first antenna pattern portion connecting the wireless communication unit to the first strap pin connector and a second antenna pattern portion connecting the wireless communication unit to the second strap pin connector and spaced apart from the first antenna pattern portion.

The electronic device may further include a pattern connector mounted on the main body, connecting the wireless communication unit to the antenna pattern, and transmitting and receiving an electrical signal through the antenna pattern. The pattern connector may include a first antenna feeder connected to the antenna pattern and including a first antenna feeder connector connected to the antenna pattern, and a second antenna feeder connected to the antenna pattern and including a second antenna feeder connector connected to the antenna pattern. The first antenna feeder and the second antenna feeder may be connected to one side of the antenna pattern.

The first antenna feeder connector and the second antenna feeder connector may be disposed on a straight line substantially parallel to the strap pin.

The strap pin may include a plurality of strap pins. First and second strap pins of the plurality of strap pins may be spaced apart from each other. The first strap pin may be electrically connected to the strap pin connector, and the second strap pin may be electrically connected to the first strap pin. The antenna pattern, the strap pin connector, the first strap pin, and the second strap pin may be electrically connected to one another and may form the antenna that transmits and receives the radio wave.

The strap pin connector may include a plurality of strap pin connectors. First and second strap pin connectors of the plurality of strap pin connectors may be electrically connected to the first strap pin and may be spaced apart from each other. Third and fourth strap pin connectors of the plurality of strap pin connectors may be electrically connected to the second strap pin and may be spaced apart from each other. An extended antenna pattern may be formed on the outer surface of the main body and may electrically connect the second strap pin connector to the third strap pin connector. The antenna pattern, the first strap pin connector, the first strap pin, the second strap pin connector, the extended antenna pattern, the third strap pin connector, and the second strap pin may be electrically connected to one another and may form the antenna that transmits and receives the radio wave.

The extended antenna pattern may include a first extended antenna pattern connected to the second strap pin connector, a second extended antenna pattern connected to the third strap pin connector, and a pattern switch configured to switch on or off an electrical connection of the first extended antenna pattern and the second extended antenna pattern.

The controller may switch on or off the pattern switch depending on a frequency of an electromagnetic wave that is transmitted and received through the antenna.

The antenna may include a plurality of antennas. First and second antennas of the plurality of antennas may transmit and receive radio waves of different frequencies and may be electrically insulated from each other.

The electronic device may further include an extended antenna pattern on the outer surface of the main body. The extended antenna pattern may include a first extended antenna pattern electrically connected to the first antenna, a second extended antenna pattern electrically connected to the second antenna, and a pattern switch configured to switch on or off an electrical connection of the first extended antenna pattern and the second extended antenna pattern.

The wireless communication unit, the antenna pattern, the strap pin connector, and the strap pin may receive an electrical signal in the order named and transmit the radio wave.

The electronic device may further include a strap connected to the strap pin, the strap including a conductive strap antenna pattern. At least one of the strap pin connector and the strap pin may be electrically connected to the strap antenna pattern. The strap pin connector, the strap pin, the antenna pattern, and the strap antenna pattern may be electrically connected to one another and may form the antenna that transmits and receives the radio wave.

According to at least one aspect of the present disclosure, the present disclosure can provide an electronic device enabling transmission and reception of communication even when a watch strap is replaced because a main antenna is disposed at a main body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
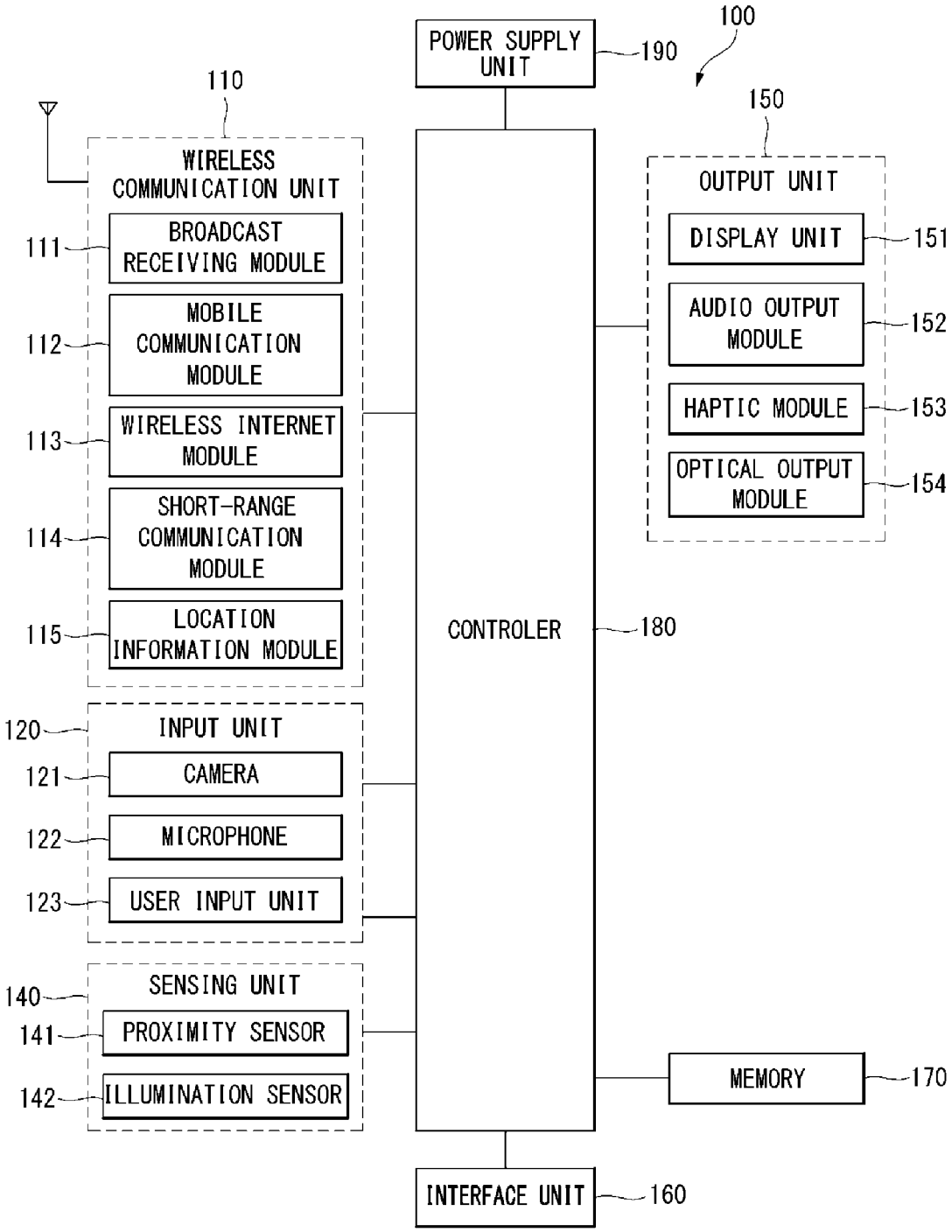
FIG. 1 is a block diagram of an electronic device related to an embodiment of the invention.

Reference will now be made in detail embodiments of the invention examples of which are illustrated in the accompanying drawings. Since the present invention may be modified in various ways and may have various forms, specific embodiments are illustrated in the drawings and are described in detail in the present specification. However, it should be understood that the present invention are not limited to specific disclosed embodiments, but include all modifications, equivalents and substitutes included within the spirit and technical scope of the present invention.

The terms 'first', 'second', etc. may be used to describe various components, but the components are not limited by such terms. The terms are used only for the purpose of distinguishing one component from other components. For example, a first component may be designated as a second component without departing from the scope of the present invention. In the same manner, the second component may be designated as the first component.

The term "and/or" encompasses both combinations of the plurality of related items disclosed and any item from among the plurality of related items disclosed.

When an arbitrary component is described as "being connected to" or "being linked to" another component, this should be understood to mean that still another component(s) may exist between them, although the arbitrary component may be directly connected to, or linked to, the second component. In contrast, when an arbitrary component is described as "being directly connected to" or "being directly linked to" another component, this should be understood to mean that no component exists between them.

The terms used in the present application are used to describe only specific embodiments or examples, and are not intended to limit the present invention. A singular expression can include a plural expression as long as it does not have an apparently different meaning in context.

In the present application, the terms "include" and "have" should be understood to be intended to designate that illustrated features, numbers, steps, operations, components, parts or combinations thereof exist and not to preclude the existence of one or more different features, numbers, steps, operations, components, parts or combinations thereof, or the possibility of the addition thereof.

Unless otherwise specified, all of the terms which are used herein, including the technical or scientific terms, have the same meanings as those that are generally understood by a person having ordinary knowledge in the art to which the present invention pertains. The terms defined in a generally used dictionary must be understood to have meanings identical to those used in the context of a related art, and are not to be construed to have ideal or excessively formal meanings unless they are obviously specified in the present application.

The following embodiments of the present invention are provided to those skilled in the art in order to describe the present invention more completely. Accordingly, shapes and sizes of elements shown in the drawings may be exaggerated for clarity.

Electronic devices disclosed herein may be implemented using a variety of different types of devices. Examples of such devices include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart watches, smart glasses, head mounted displays (HMDs)), and the like.

By way of non-limiting example only, further description will be made with reference to particular types of electronic devices. However, such teachings apply equally to other types of electronic devices, such as those types noted above. In addition, these teachings may also be applied to stationary terminals such as digital TV, desktop computers, and the like.

Reference is now made to FIG. 1, where FIG. 1 is a block diagram of an electronic device related to an embodiment of the invention.

An electronic device 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components is not a requirement, and that greater or fewer components may alternatively be implemented.

Referring now to FIG. 1, the electronic device 100 is shown having the wireless communication unit 110 configured with several commonly implemented components. For instance, the wireless communication unit 110 typically includes one or more components which permit wireless communication between the electronic device 100 and a wireless communication system or network within which the electronic device is located.

The wireless communication unit 110 typically includes one or more modules which permit communications such as wireless communications between the electronic device 100 and a wireless communication system, communications between the electronic device 100 and another electronic device, communications between the electronic device 100 and an external server. Further, the wireless communication unit 110 typically includes one or more modules which connect the electronic device 100 to one or more networks. To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the electronic device, the surrounding environment of the electronic device, user information, and the like. For example, in FIG. 1, the sensing unit 140 is shown having a proximity sensor 141 and an illumination sensor 142. If desired, the sensing unit 140 may alternatively or additionally include other types of sensors or devices, such as a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The electronic device 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154.

The display unit 151 may have an inter-layered structure or an integrated structure with a touch sensor in order to facilitate a touch screen. The touch screen may provide an output interface between the electronic device 100 and a user, as well as function as the user input unit 123 which provides an input interface between the electronic device 100 and the user.

The interface unit 160 serves as an interface with various types of external devices that can be coupled to the electronic device 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the electronic device 100 may perform assorted control functions associated with a connected external device, in response to the external device being connected to the interface unit 160.

The memory 170 is typically implemented to store data to support various functions or features of the electronic device 100. For instance, the memory 170 may be configured to store application programs executed in the electronic device 100, data or instructions for operations of the electronic device 100, and the like. Some of these application programs may be downloaded from an external server via wireless communication. Other application programs may be installed within the electronic device 100 at time of manufacturing or shipping, which is typically the case for basic functions of the electronic device 100 (for example, receiving a call, placing a call, receiving a message, sending a message, and the like). It is common for application programs to be stored in the memory 170, installed in the electronic device 100, and executed by the controller 180 to perform an operation (or function) for the electronic device 100.

The controller 180 typically functions to control overall operation of the electronic device 100, in addition to the operations associated with the application programs. The controller 180 may provide or process information or functions appropriate for a user by processing signals, data, information and the like, which are input or output by the various components depicted in FIG. 1, or activating application programs stored in the memory 170. As one example, the controller 180 controls some or all of the components illustrated in FIG. 1 according to the execution of an application program that have been stored in the memory 170.

The power supply unit 190 can be configured to receive external power or provide internal power in order to supply appropriate power required for operating elements and components included in the electronic device 100. The power supply unit 190 may include a battery, and the battery may be configured to be embedded in the device body, or configured to be detachable from the device body.

At least some of the above components may be combined with one another and operate, in order to implement an operation, a control, or a control method of an electronic device according to various embodiments described below. Further, an operation, a control, or a control method of an electronic device according to various embodiments may be implemented by an execution of at least one application program stored in the memory 170.

Referring still to FIG. 1, various components depicted in this figure will now be described in more detail.

Regarding the wireless communication unit 110, the broadcast receiving module 111 is typically configured to receive a broadcast signal and/or broadcast associated information from an external broadcast managing entity via a broadcast channel. The broadcast channel may include a satellite channel, a terrestrial channel, or both. In some embodiments, two or more broadcast receiving modules 111 may be utilized to facilitate simultaneously receiving of two or more broadcast channels, or to support switching among broadcast channels.

The controller 180 includes an integrated circuit (IC), and a typical example of the IC may include an application processor (AP). The AP may function to perform an overall operation and an overall control of the electronic device. The controller 180 may additionally include a plurality of ICs for a control of each component. The ICs may be mounted on a substrate and may transmit and receive signals through a circuit implemented on the substrate, thereby controlling each component.

The mobile communication module 112 can transmit and/or receive wireless signals to and from one or more network entities. Typical examples of a network entity include a base station, an external electronic device, a server, and the like. Such network entities form part of a mobile communication network, which is constructed according to technical standards or communication methods for mobile communications (for example, Global System for Mobile Communication (GSM), Code Division Multi Access (CDMA), CDMA2000 (Code Division Multi Access 2000), EV-DO (Enhanced Voice-Data Optimized or Enhanced Voice-Data Only), Wideband CDMA (WCDMA), High Speed Downlink Packet access (HSDPA), HSUPA (High Speed Uplink Packet Access), Long Term Evolution (LTE), LTE-A (Long Term Evolution-Advanced), and the like).

Examples of wireless signals transmitted and/or received via the mobile communication module 112 include audio call signals, video (telephony) call signals, or various formats of data to support communication of text and multimedia messages.

The wireless Internet module 113 is configured to facilitate wireless Internet access. This module may be internally or externally coupled to the electronic device 100. The wireless Internet module 113 may transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), HSUPA (High Speed Uplink Packet Access), Long Term Evolution (LTE), LTE-A (Long Term Evolution-Advanced), and the like. The wireless Internet module 113 may transmit/receive data according to one or more of such wireless Internet technologies, and other Internet technologies as well.

In some embodiments, when the wireless Internet access is implemented according to, for example, WiBro, HSDPA, HSUPA, GSM, CDMA, WCDMA, LTE, LTE-A and the like, as part of a mobile communication network, the wireless Internet module 113 performs such wireless Internet access. As such, the Internet module 113 may cooperate with, or function as, the mobile communication module 112.

The short-range communication module 114 is configured to facilitate short-range communications. Suitable technologies for implementing such short-range communications include BLUETOOTH™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), and the like. The short-range communication module 114 in general supports wireless communications between the electronic device 100 and a wireless communication system, communications between the electronic device 100 and another electronic device 100, or communications between the electronic device and a network where another electronic device 100 (or an external server) is located, via wireless area networks. One example of the wireless area networks is a wireless personal area networks.

In some embodiments, another electronic device (which may be configured similarly to the electronic device 100) may be a wearable device, for example, a smart watch, a smart glass or a head mounted display (HMD), which is able to exchange data with the electronic device 100 (or otherwise cooperate with the electronic device 100). The short-range communication module 114 may sense or recognize the wearable device, and permit communication between the wearable device and the electronic device 100. In addition, when the sensed wearable device is a device which is authenticated to communicate with the electronic device 100, the controller 180, for example, may cause transmission of data processed in the electronic device 100 to the wearable device via the short-range communication module 114. Hence, a user of the wearable device may use the data processed in the electronic device 100 on the wearable device. For example, when a call is received in the electronic device 100, the user may answer the call using the wearable device. Also, when a message is received in the electronic device 100, the user can check the received message using the wearable device.

The location information module 115 is generally configured to detect, calculate, derive or otherwise identify a position of the electronic device. As an example, the location information module 115 includes a Global Position System (GPS) module, a Wi-Fi module, or both. If desired, the location information module 115 may alternatively or additionally function with any of the other modules of the wireless communication unit 110 to obtain data related to the position of the electronic device. As one example, when the electronic device uses a GPS module, a position of the electronic device may be acquired using a signal sent from a GPS satellite. As another example, when the electronic device uses the Wi-Fi module, a position of the electronic device can be acquired based on information related to a wireless access point (AP) which transmits or receives a wireless signal to or from the Wi-Fi module.

The input unit 120 may be configured to permit various types of input to the electronic device 100. Examples of such input include audio, image, video, data, and user input. Image and video input is often obtained using one or more cameras 121. Such cameras 121 may process image frames of still pictures or video obtained by image sensors in a video or image capture mode. The processed image frames can be displayed on the display unit 151 or stored in memory 170. In some cases, the cameras 121 may be arranged in a matrix configuration to permit a plurality of images having various angles or focal points to be input to the electronic device 100. As another example, the cameras 121 may be located in a stereoscopic arrangement to acquire left and right images for implementing a stereoscopic image.

The microphone 122 is generally implemented to permit audio input to the electronic device 100. The audio input can be processed in various manners according to a function being executed in the electronic device 100. If desired, the microphone 122 may include assorted noise removing algorithms to remove unwanted noise generated in the course of receiving the external audio.

The user input unit 123 is a component that permits input by a user. Such user input may enable the controller 180 to control operation of the electronic device 100. The user input unit 123 may include one or more of a mechanical input element (for example, a key, a button located on a front and/or back surface or a side surface of the electronic device 100, a dome switch, a jog wheel, a jog switch, and the like), or a touch-sensitive input, among others. As one example, the touch-sensitive input may be a virtual key or a soft key, which is displayed on a touch screen through software processing, or a touch key which is located on the electronic device at a location that is other than the touch screen. On the other hand, the virtual key or the visual key may be displayed on the touch screen in various shapes, for example, graphic, text, icon, video, or a combination thereof.

The sensing unit 140 is generally configured to sense one or more of internal information of the electronic device, surrounding environment information of the electronic device, user information, or the like. The controller 180 generally cooperates with the sending unit 140 to control operation of the electronic device 100 or execute data processing, a function or an operation associated with an application program installed in the electronic device based on the sensing provided by the sensing unit 140. The sensing unit 140 may be implemented using any of a variety of sensors, some of which will now be described in more detail.

The proximity sensor 141 may include a sensor to sense presence or absence of an object approaching a surface, or an object located near a surface, by using an electromagnetic field, infrared rays, or the like without a mechanical contact. The proximity sensor 141 may be arranged at an inner region of the electronic device covered by the touch screen, or near the touch screen.

The proximity sensor 141, for example, may include any of a transmissive type photoelectric sensor, a direct reflective type photoelectric sensor, a mirror reflective type photoelectric sensor, a high-frequency oscillation proximity sensor, a capacitive proximity sensor, a magnetic proximity sensor, an infrared proximity sensor, and the like. When the touch screen is implemented as a capacitive touch sensor, the proximity sensor 141 can sense proximity of a pointer relative to the touch screen by changes of an electromagnetic field, which is responsive to an approach of an object with conductivity. In this case, the touch screen (touch sensor) may also be categorized as a proximity sensor.

The term "proximity touch" will often be referred to herein to denote the scenario in which a pointer is positioned to be proximate to the touch screen without contacting the touch screen. The term "contact touch" will often be referred to herein to denote the scenario in which a pointer makes physical contact with the touch screen. For the position corresponding to the proximity touch of the pointer relative to the touch screen, such position will correspond to a position where the pointer is perpendicular to the touch screen. The proximity sensor 141 may sense proximity touch, and proximity touch patterns (for example, distance, direction, speed, time, position, moving status, and the like). In general, controller 180 processes data corresponding to proximity touches and proximity touch patterns sensed by the proximity sensor 141, and cause output of visual information on the touch screen. In addition, the controller 180 can control the electronic device 100 to execute different operations or process different data according to whether a touch with respect to a point on the touch screen is either a proximity touch or a contact touch.

A touch sensor can sense a touch applied to the touch screen, such as display unit 151, using any of a variety of touch methods. Examples of such touch methods include a resistive type, a capacitive type, an infrared type, and a magnetic field type, among others.

As one example, the touch sensor may be configured to convert changes of pressure applied to a specific part of the display unit 151, or convert capacitance occurring at a specific part of the display unit 151, into electric input signals. The touch sensor may also be configured to sense not only a touched position and a touched area, but also touch pressure and/or touch capacitance. A touch object is generally used to apply a touch input to the touch sensor. Examples of typical touch objects include a finger, a touch pen, a stylus pen, a pointer, or the like.

When a touch input is sensed by a touch sensor, corresponding signals may be transmitted to a touch controller. The touch controller may process the received signals, and then transmit corresponding data to the controller 180. Accordingly, the controller 180 may sense which region of the display unit 151 has been touched. Here, the touch controller may be a component separate from the controller 180, the controller 180, and combinations thereof.

In some embodiments, the controller 180 may execute the same or different controls according to a type of touch object that touches the touch screen or a touch key provided in addition to the touch screen. Whether to execute the same or different control according to the object which provides a touch input may be decided based on a current operating state of the electronic device 100 or a currently executed application program, for example.

The touch sensor and the proximity sensor may be implemented individually, or in combination, to sense various types of touches. Such touches includes a short (or tap) touch, a long touch, a multi-touch, a drag touch, a flick touch, a pinch-in touch, a pinch-out touch, a swipe touch, a hovering touch, and the like.

If desired, an ultrasonic sensor may be implemented to recognize position information relating to a touch object using ultrasonic waves. The controller 180, for example, may calculate a position of a wave generation source based on information sensed by an illumination sensor and a plurality of ultrasonic sensors. Since light is much faster than ultrasonic waves, the time for which the light reaches the optical sensor is much shorter than the time for which the ultrasonic wave reaches the ultrasonic sensor. The position of the wave generation source may be calculated using this fact. For instance, the position of the wave generation source may be calculated using the time difference from the time that the ultrasonic wave reaches the sensor based on the light as a reference signal.

The camera 121 typically includes at least one a camera sensor (CCD, CMOS etc.), a photo sensor (or image sensors), and a laser sensor.

Implementing the camera 121 with a laser sensor may allow detection of a touch of a physical object with respect to a 3D stereoscopic image. The photo sensor may be laminated on, or overlapped with, the display device. The photo sensor may be configured to scan movement of the physical object in proximity to the touch screen. In more detail, the photo sensor may include photo diodes and transistors at rows and columns to scan content received at the photo sensor using an electrical signal which changes according to the quantity of applied light. Namely, the photo sensor may calculate the coordinates of the physical object according to variation of light to thus obtain position information of the physical object.

The display unit 151 is generally configured to output information processed in the electronic device 100. For example, the display unit 151 may display execution screen information of an application program executing at the electronic device 100 or user interface (UI) and graphic user interface (GUI) information in response to the execution screen information.

In some embodiments, the display unit 151 may be implemented as a stereoscopic display unit for displaying stereoscopic images.

A typical stereoscopic display unit may employ a stereoscopic display scheme such as a stereoscopic scheme (a glass scheme), an auto-stereoscopic scheme (glassless scheme), a projection scheme (holographic scheme), or the like.

The audio output module 152 is generally configured to output audio data. Such audio data may be obtained from any of a number of different sources, such that the audio data may be received from the wireless communication unit 110 or may have been stored in the memory 170. The audio data may be output during modes such as a signal reception mode, a call mode, a record mode, a voice recognition mode, a broadcast reception mode, and the like. The audio output module 152 can provide audible output related to a particular function (e.g., a call signal reception sound, a message reception sound, etc.) performed by the electronic device 100. The audio output module 152 may also be implemented as a receiver, a speaker, a buzzer, or the like.

A haptic module 153 can be configured to generate various tactile effects that a user feels, perceive, or otherwise experience. A typical example of a tactile effect generated by the haptic module 153 is vibration. The strength, pattern and the like of the vibration generated by the haptic module 153 can be controlled by user selection or setting by the controller. For example, the haptic module 153 may output different vibrations in a combining manner or a sequential manner.

Besides vibration, the haptic module 153 can generate various other tactile effects, including an effect by stimulation such as a pin arrangement vertically moving to contact skin, a spray force or suction force of air through a jet orifice or a suction opening, a touch to the skin, a contact of an electrode, electrostatic force, an effect by reproducing the sense of cold and warmth using an element that can absorb or generate heat, and the like.

The haptic module 153 can also be implemented to allow the user to feel a tactile effect through a muscle sensation such as the user's fingers or arm, as well as transferring the tactile effect through direct contact. Two or more haptic modules 153 may be provided according to the particular configuration of the electronic device 100.

An optical output module 154 can output a signal for indicating an event generation using light of a light source. Examples of events generated in the electronic device 100 may include message reception, call signal reception, a missed call, an alarm, a schedule notice, an email reception, information reception through an application, and the like.

A signal output by the optical output module 154 may be implemented in such a manner that the electronic device emits monochromatic light or light with a plurality of colors. The signal output may be terminated as the electronic device senses that a user has checked the generated event, for example.

The interface unit 160 serves as an interface for external devices to be connected with the electronic device 100. For example, the interface unit 160 can receive data transmitted from an external device, receive power to transfer to elements and components within the electronic device 100, or transmit internal data of the electronic device 100 to such external device. The interface unit 160 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating authority of using the electronic device 100 and may include a user identity module (UIM), a subscriber identity module (SIM), a universal subscriber identity module (USIM), and the like. In addition, the device having the identification module (also referred to herein as an "identifying device") may take the form of a smart card. Accordingly, the identifying device can be connected with the electronic device 100 via the interface unit 160.

When the electronic device 100 is connected with an external cradle, the interface unit 160 can serve as a passage to allow power from the cradle to be supplied to the electronic device 100 or may serve as a passage to allow various command signals input by the user from the cradle to be transferred to the electronic device there through. Various command signals or power input from the cradle may operate as signals for recognizing that the electronic device is properly mounted on the cradle.

The memory 170 can store programs to support operations of the controller 180 and store input/output data (for example, phonebook, messages, still images, videos, etc.). The memory 170 may store data related to various patterns of vibrations and audio which are output in response to touch inputs on the touch screen.

The memory 170 may include one or more types of storage mediums including a Flash memory, a hard disk, a solid state disk, a silicon disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, an optical disk, and the like. The electronic device 100 may also be operated in relation to a network storage device that performs the storage function of the memory 170 over a network, such as the Internet.

The controller 180 may typically control the general operations of the electronic device 100. For example, the controller 180 may set or release a lock state for restricting a user from inputting a control command with respect to applications when a status of the electronic device meets a preset condition.

The controller 180 can also perform the controlling and processing associated with voice calls, data communications, video calls, and the like, or perform pattern recognition processing to recognize a handwriting input or a picture drawing input performed on the touch screen as characters or images, respectively. In addition, the controller 180 can control one or a combination of those components in order to implement various exemplary embodiments disclosed herein.

The power supply unit 190 may receive external power or provide internal power and supply the appropriate power required for operating respective elements and components included in the electronic device 100. The power supply unit 190 may include a battery, which is typically rechargeable or be detachably coupled to the device body for charging.

The power supply unit 190 may include a connection port. The connection port may be configured as one example of the interface unit 160 to which an external charger for supplying power to recharge the battery is electrically connected.

As another example, the power supply unit 190 may be configured to recharge the battery in a wireless manner without use of the connection port. In this example, the power supply unit 190 can receive power, transferred from an external wireless power transmitter, using at least one of an inductive coupling method which is based on magnetic induction or a magnetic resonance coupling method which is based on electromagnetic resonance.

Various embodiments described herein may be implemented in a computer-readable medium, a machine-readable medium, or similar medium using, for example, software, hardware, or any combination thereof.

The electronic device may be expanded to a wearable device the user can directly wear beyond a hand-held device, which the user has and uses in his or her hand. Examples of the wearable device include a smart watch, a smart glass, and a head mounted display (HMD). Examples of the electronic device expanded to the wearable device will now be described in more detail.

The wearable device may be configured to exchange (or interwork) data with another electronic device 100. The short-range communication module 114 may sense (or recognize) the wearable device, which is positioned around the electronic device 100 and can communicate with the electronic device 100. Furthermore, when the sensed wearable device is a device which is authenticated to communicate with the electronic device 100, the controller 180 may transmit at least a portion of data processed in the electronic device 100 to the wearable device via the short-range communication module 114. Thus, the user of the wearable device may use the data processed in the electronic device 100 on the wearable device. For example, when a call is received in the electronic device 100, the user may answer the call using the wearable device. Also, when a message is received in the electronic device 100, the user may check the received message using the wearable device.

At least a portion of the components illustrated in FIG. 1 may cooperatively operate to implement an operation, a control, or a control method of the electronic device 100 according to various embodiments of the invention that will be described below. The operation, the control, or the control method of the electronic device 100 may be implemented by the execution of at least one application program stored in the memory 170.

The watch electronic device 100 according to the embodiment of the invention is a kind of the mobile terminal which the user wears on his/her wrist. The watch electronic device 100 may include some or all of the components illustrated in FIG. 1. The characteristics of the watch electronic device 100 related to its shape will now be described in detail.

Figure 2:
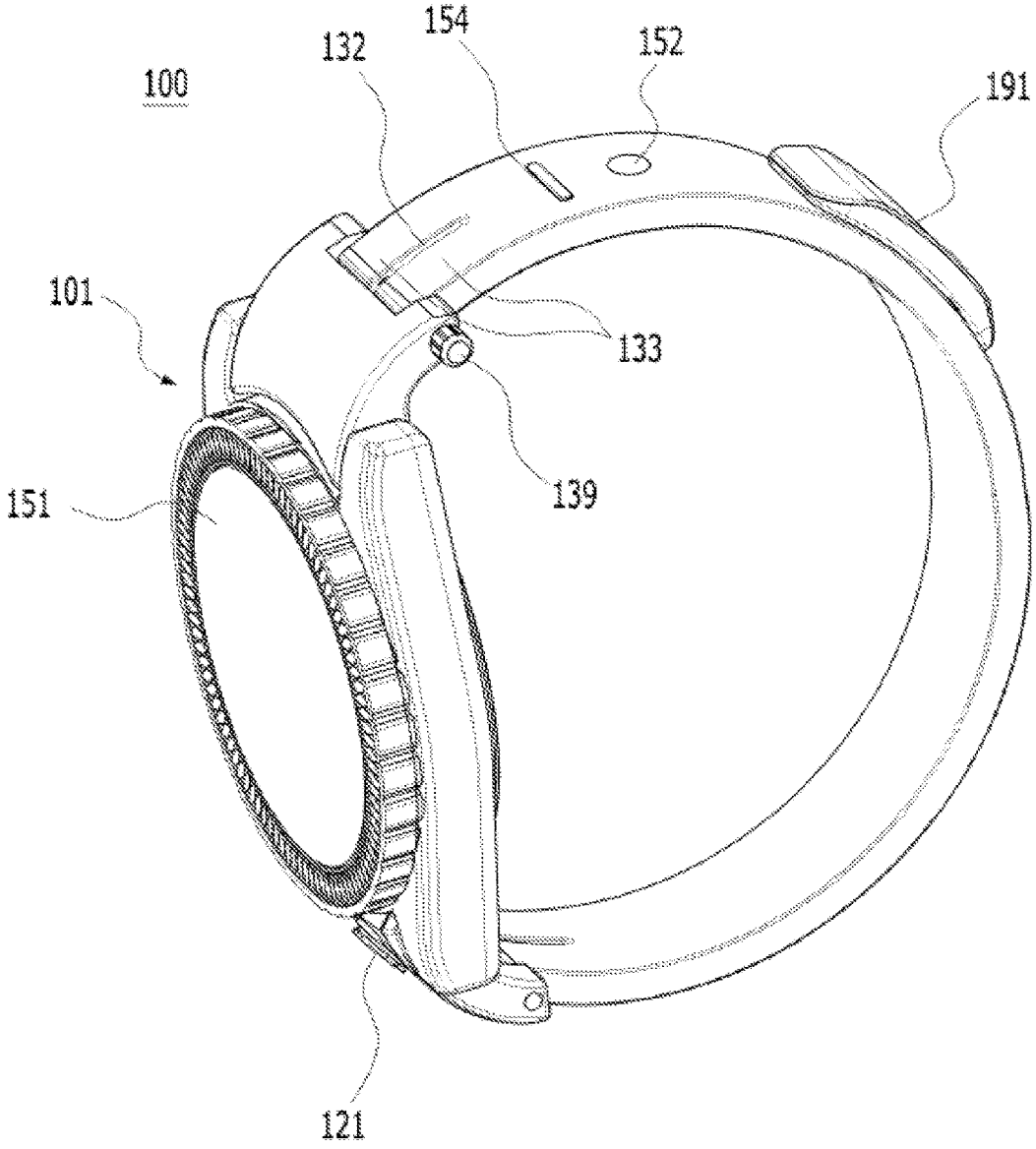
FIG. 2 is a perspective view of an electronic device related to an embodiment of the invention.
Figure 3:
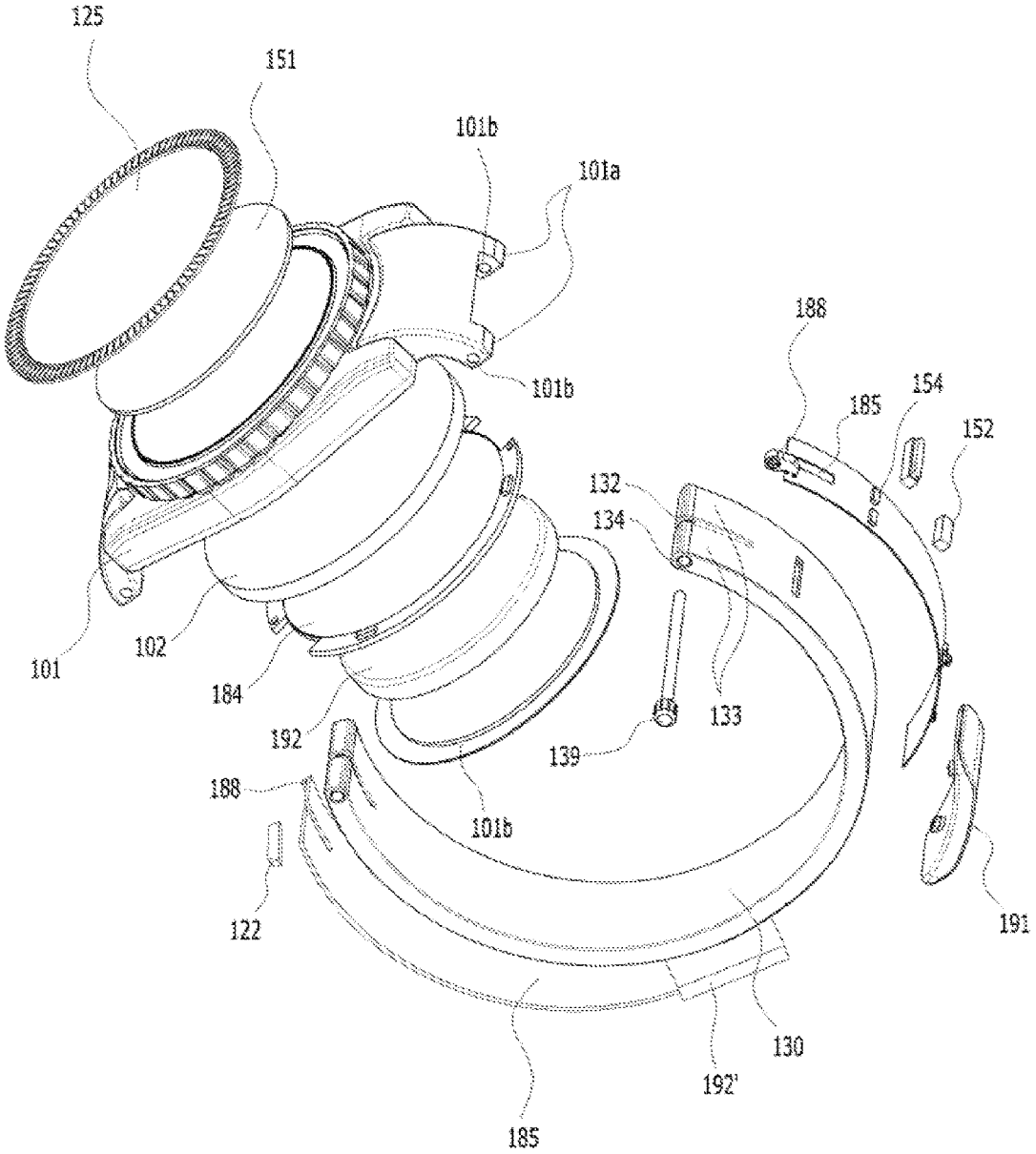
FIG. 3 is an exploded perspective view of an electronic device shown in FIG. 2.

FIG. 2 is a perspective view of an electronic device related to an embodiment of the invention. FIG. 3 is an exploded perspective view of an electronic device shown in FIG. 2.

An electronic device according to an embodiment of the invention includes a band 130 which has a curved surface in a longitudinal direction or includes a flexible material. The band 130 may be detachable from a main body 101 of the electronic device using a hinge pin 139.

When the band 130 is made of a material with rigidity, the band 130 may have a curved shape. Alternatively, when the band 130 is made of the flexible material, the band 130 may be flexible. Hence, the user can wear the band 130 by winding the band 130 on his/her wrist. A mounting part, on which electronic components can be mounted, is provided inside the band 130. A band substrate 185, the audio output module 152, the microphone 122, the optical output module 154, an antenna (not shown), etc. may be mounted on the mounting part.

Figure 4A:
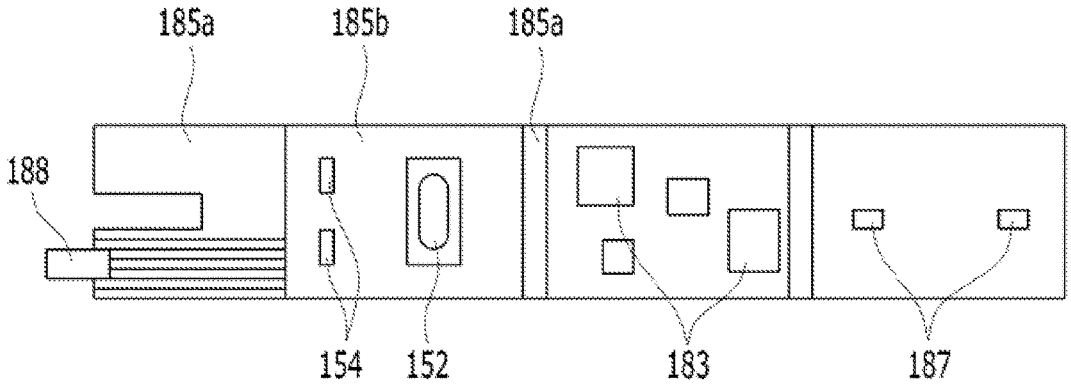
FIGS. 4A and 4B are plane views illustrating a band substrate of an electronic device related to an embodiment of the invention.
Figure 4B:
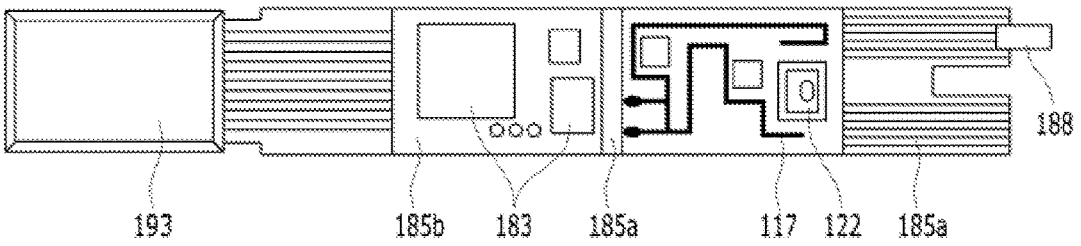

FIGS. 4A and 4B are plane views illustrating the band substrate 185 of the electronic device related to an embodiment of the invention. The band substrate 185 includes a flexible substrate. As shown in FIGS. 4A and 4B, a substrate formed of a hard material may be configured as a plurality of parts, and the flexible substrate may be interposed between the plurality of parts. Alternatively, the band substrate 185 may be entirely formed of a flexible material.

An integrated circuit (IC) 183 is mounted on the band substrate 185 and controls the audio output module 152, the microphone 122, the optical output module 154, the wireless communication unit 110, etc. mounted on the band 130. When the IC 183 is connected to the main body 101, the IC 183 may also control the main body 101. The audio output module 152, the microphone 122, the optical output module 154, an antenna 117, etc. may be mounted on the band 130 separately from the band substrate 185, but may be mounted on the band substrate 185 as shown in FIGS. 4A and 4B.

As shown in FIG. 3, the band substrates 185 respectively positioned on both sides of the band 130 may be separated from each other and may be combined to form one band substrate 185. Even if the band substrates 185 are separated from each other, the separated band substrates 185 may be connected to each other when ends of the band 130 are connected to the main body 101 or the ends of the band 130 are connected to each other.

The audio output module 152, the optical output module 154, and the IC 183 are positioned on the band substrate 185 disposed on one side of the band 130. Also, a terminal connected to an external battery 191 may be positioned thereon. The microphone 122, the antenna 117, the IC 183, and an internal battery 192' may be mounted on the band substrate 185 disposed on the other side of the band 130. The above arrangement of the band substrate 185 may be changed, and more components including the components noted above may be mounted on the band substrate 185.

A slit 132 extending in a longitudinal direction of the band 130 is positioned at the end of the band 130. In the embodiment of the invention, the slits 132 are respectively formed at both ends of the band 130, and each end of the band 130 is divided into two division ends 133 by the slit 132. The number of division ends 133 increases depending on an increase in the number of slits 132.

Even when the band 130 is made of the material with rigidity, the division end 133 may be made of a flexible material. The division ends 133 may bend up and down in a thickness direction of the band 130 and also may bend in different directions.

The band 130 may include a fastening hole 134 extending at the end of the band 130, i.e., at the side of the division end 133 in a width direction of the band 130. The hinge pin 139 is fastened to the fastening hole 134, thereby connecting the band 130 to the main body 101. The main body 101 includes a hinge hole 101*b*, through which the hinge pin 139 passes.

The hinge pin 139 passing through the band 130 may be formed of a conductive material and may be electrically connected to a connection ring 188 which is positioned inside the fastening hole 134 and the hinge hole 101*b*. The connection ring 188 is a ring-shaped member which is positioned inside the fastening hole 134 of the band 130 and is formed of the conductive material. An end of the connection ring 188 may be connected to the band substrate 185 mounted on the band 130.

A clock plate 102 including markings, an hour hand, a minute hand, a second hand, etc. is positioned on a front surface of the main body 101. The main body 101 includes a band fastening part 101*a*, which is coupled to the band 130 through the hinge pin 139, at each side of the main body 101. The band fastening part 101*a* includes a pair of fastening protrusions, which are spaced apart from each other by a distance corresponding to a width of the band 130, and the hinge holes 101*b* formed in the fastening protrusions. As described above, the hinge pin 139 is inserted into the hinge holes 101*b* and fastens the band 130 to the main body 101.

The main body 101 may be a clock body having only a function of a general wristwatch. The general wristwatch has the band fastening part 101*a* so as to replace a band of the wristwatch, and the band 130 can be replaced by inserting the hinge pin 139 into the hinge holes 101*b* of the band fastening part 101*a*. Thus, the electronic device according to the embodiment of the invention may be fastened to the general main body 101.

Even in case of the main body 101, on which the electronic components are not separately mounted, the main body 101 may include a battery 192 for driving the clock plate 102. The battery 192 may be used only in a drive of the clock plate 102. The battery included in the band 130 itself may be used to drive the electronic components of the band 130 and used to drive the display unit 151 when the display unit 151 is additionally coupled to the main body 101.

Alternatively, as shown in FIG. 3, the main body 101, on the electronic components are mounted, may be used. The main body 101 includes the display unit 151, a circuit unit 184 for the control, and a main battery 192 for supplying electric power. As shown in FIG. 3, the structure, for example, the camera 121, which is not included in the electronic device, may be included in the main body 101.

When the display unit 151 is used as a display of the general wristwatch, the display unit 151 is maintained in a transparent state. Only when information is output through the display unit 151, the display unit 151 may be changed to an opaque or translucent display. A touch sensor 125 is positioned on a front surface of the display unit 151 and may simultaneously perform input and output operations.

When the electronic components are mounted on the main body 101, the connection ring 188 is positioned inside the hinge hole 101*b* for the electrical connection between the electronic components. Hence, the electronic components of the main body 101 may be connected to the circuit unit 184 inside the main body 101 through the connection ring 188. A function of the electronic device may be expanded through the connection between the main body 101 and the band 130.

For example, when the band 130 is connected to the main body 101 having only a display function, wireless communication with a base station, or a call or transmission and reception of data through short range communication can be performed using the antenna 117 included in the band 130. Also, audio information may be output via the audio output module 152 included in the band 130.

In addition to the connection between the band 130 and the main body 101 through the end of the band 130, the main body 101 may be connected to an external power source through the hinge pin 139 to receive electric power, or may be connected to an external terminal, for example, a computer.

The electronic device according to the embodiment of the invention may apply a short range communication technology, such as Bluetooth™, Radio Frequency Identification (RFID), Infrared Data Association (IrDA), Ultra Wideband (UWB), ZigBee, Near Field Communication (NFC), and Wireless Universal Serial Bus (USB).

An NFC module included in the electronic device supports contactless type near field communication between terminals at a distance of typically 10 cm or less. The NFC module may operate in one of a card mode, a reader mode, and a peer-to-peer (P2P) mode. The electronic device 100 may further include a security module storing card information, so as to operate the NFC module in the card mode. In embodiments disclosed herein, the security module may be physical media, such as universal integrated circuit card (UICC) (for example, subscriber identification module (SIM) or universal SIM (USIM)), secure micro SD, and a sticker, and may be logical media (for example, embedded secure element (SE) embedded in the electronic device. Data exchange based on single wire protocol (SWP) may be performed between the NFC module and the security module.

When the NFC module operates in the card mode, the electronic device may transfer card information, which has been stored in the same manner as an existing IC card, to the outside. More specifically, when the electronic device storing information of a payment card (for example, a credit card and a transportation card) approaches a payment machine, NFC-enabled mobile payment may be performed. When the electronic device storing information of an access card approaches an access machine, an access approval procedure may start. The credit card, the transportation card, the access card, etc. may be mounted on the security module in the applet, and the security module may store information of the cards mounted thereon. The information of the payment card may include at least one of a card number, balance, and details of usage. The information of the access card may include at least one of a user name, a user ID number, and an access history.

When the NFC module operates in the reader mode, the electronic device may read data from an external tag. In this instance, data the electronic device receives from the tag may be coded into a data exchange format defined in the NFC forum. Further, the NFC forum defines four record types. More specifically, the NFC forum defines four record type definitions (RTDs) including smart poster, text, uniform resource identifier (URI), and general control. When the data received from the tag is the smart poster type, the controller 180 may execute browser (for example, internet browser). When the data received from the tag is the text type, the controller 180 may execute a text viewer. When the data received from the tag is the URI type, the controller 180 may execute browser or make a call. When the data received from the tag is the general control type, the controller 180 may perform a proper operation depending on control contents.

When the NFC module operates in the P2P mode, the electronic device may perform P2P communication with other electronic device. In this instance, logical link control protocol (LLCP) may be applied to the P2P communication. A connection may be produced between the electronic device and the other electronic device for the P2P communication. The connection may be divided into a connectionless mode, in which one packet switching is performed and ended, and a connection-oriented mode, in which packet switching is successively performed. Through the P2P communication, data, for example, electronic business cards, contact information, digital photographs, and URL, Bluetooth, a setup parameter for WiFi, etc. may be exchanged through the P2P communication. Because an available distance of the NFC communication is short, the P2P mode may be efficiently used to exchange data of small size.

Hereinafter, embodiments related to an antenna which may be implemented in the electronic device configured as above are described with reference to the accompanying drawings. It is apparent to those skilled in the art that various modifications can be made to the invention without departing from the spirit and essential features of the present invention.

Figure 5:
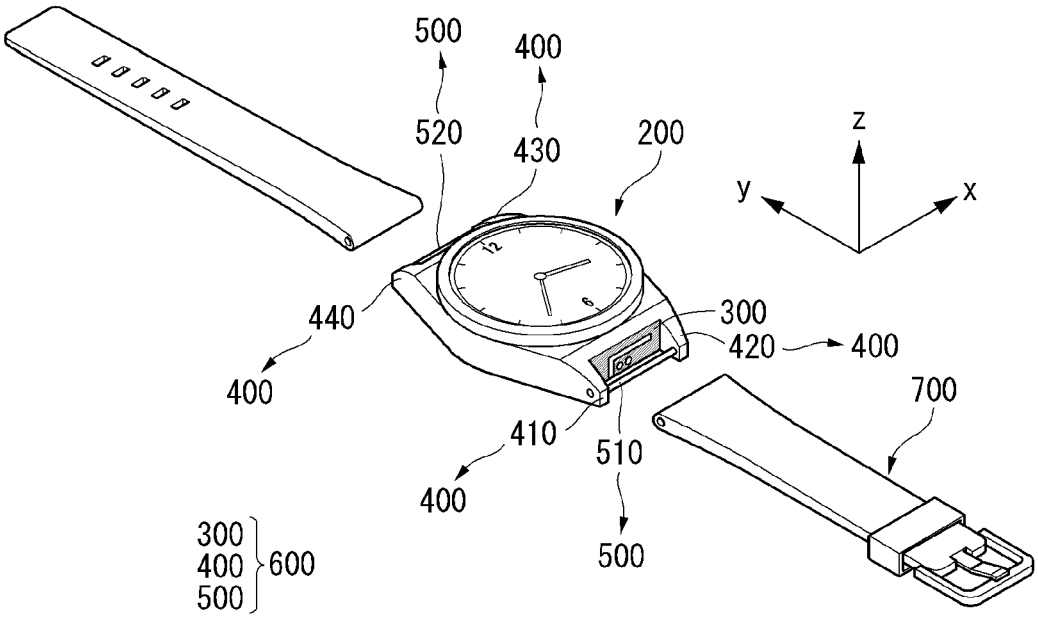
FIG. 5 is a perspective view of an electronic device according to an embodiment of the invention.

FIG. 5 is a perspective view of an electronic device according to an embodiment of the invention. In FIG. 5, x-axis may be a transverse direction, y-axis may be a longitudinal direction, and z-axis may be a height direction.

An electronic device according to an embodiment of the invention may include a main body 200, an antenna pattern 300, a strap pin connector 400, a strap pin 500, and a strap 700.

The main body 200 may include a printed circuit board (PCB) 240 (see FIG. 8), and the wireless communication unit 110 (see FIG. 1) and the controller 180 (see FIG. 1) may be mounted on the PCB 240. In embodiments disclosed herein, the wireless communication unit 110 may be a module that generates an electrical signal to be supplied to an antenna 600 or receives the electrical signal from the antenna 600.

The strap 700 may be connected to the main body 200. The electronic device according to the embodiment of the invention may be worn on a user's body. For example, the electronic device according to the embodiment of the invention may be worn on a user's wrist. In this instance, the strap 700 may cause the main body 200 to be at a predetermined location of the user's wrist.

The strap pin 500 may connect the main body 200 to the strap 700. The strap pin 500 may be spaced apart from the main body 200. At least a portion of the strap pin 500 may have conductivity. For example, a portion of the strap pin 500 may be made of a conductive metal, or the strap pin 500 may be entirely made of a conductive metal. Alternatively, the strap pin 500 may be formed using injection molding, and at least a portion of an inside of the strap pin 500 may be made of metal or at least a portion of a surface of the strap pin 500 may be plated with metal. The strap pin 500 may be in plural. For example, the plurality of strap pins 500 may include a first strap pin 510 and a second strap pin 520.

The strap pin connector 400 may protrude from the main body 200. At least a portion of the strap pin connector 400 may have conductivity. For example, a portion of the strap pin connector 400 may be made of metal, or the strap pin connector 400 may be entirely made of metal. Alternatively, the strap pin connector 400 may be formed using injection molding, and at least a portion of an inside of the strap pin connector 400 may be made of metal or at least a portion of a surface of the strap pin connector 400 may be made of metal. The strap pin connector 400 may be physically and electrically connected to the strap pin 500.

The strap pin connector 400 may be in plural and may be paired. For example, a first strap pin connector 410 and a second strap pin connector 420 may be respectively connected to both ends of the first strap pin 510, and a third strap pin connector 430 and a fourth strap pin connector 440 may be respectively connected to both ends of the second strap pin 520.

The antenna pattern 300 may be formed in an insulating portion of an outer surface of the main body 200. The outer surface of the main body 200 may include all of an upper part, a lower part, and a side part of the outer surface of the main body 200. The antenna pattern 300 may have electrical conductivity and may be connected to the wireless communication unit 110. The antenna pattern 300 may be electrically connected to the strap pin connector 400. Thus, the wireless communication unit 110, the antenna pattern 300, the strap pin connector 400, and the strap pin 500 may be electrically connected to one another in the order named.

The antenna 600 may transmit and receive radio waves. The antenna 600 may include the antenna pattern 300, the strap pin connector 400, and the strap pin 500. The wireless communication unit 110 may apply an electrical signal to the antenna pattern 300. The antenna pattern 300, the strap pin connector 400, and the strap pin 500 may receive the electrical signal from the wireless communication unit 110 and radiate the radio waves. This process may be a process for transmitting radio waves by the electronic device according to the embodiment of the invention.

A process for receiving the radio waves by the electronic device according to the embodiment of the invention is described below. At least one of the strap pin 500, the strap pin connector 400, and the antenna pattern 300 may generate an electrical signal in response to electromagnetic waves, and the electrical signal may be transferred to the wireless communication unit 110.

As shown in FIG. 5, the antenna 600 may be formed independently from the strap 700. A configuration of the antenna 600 formed independently from the strap 700 can further reduce an influence of a replacement of the strap 700 on a configuration of the antenna 600, compared to a configuration of the antenna 600 related to the strap 700. For example, when the antenna 600 is positioned or mounted at the strap 700, it may be difficult to replace the strap 700. However, when the antenna 600 is formed independently from the strap 700, it may be easy to replace the strap 700.

Figure 6:
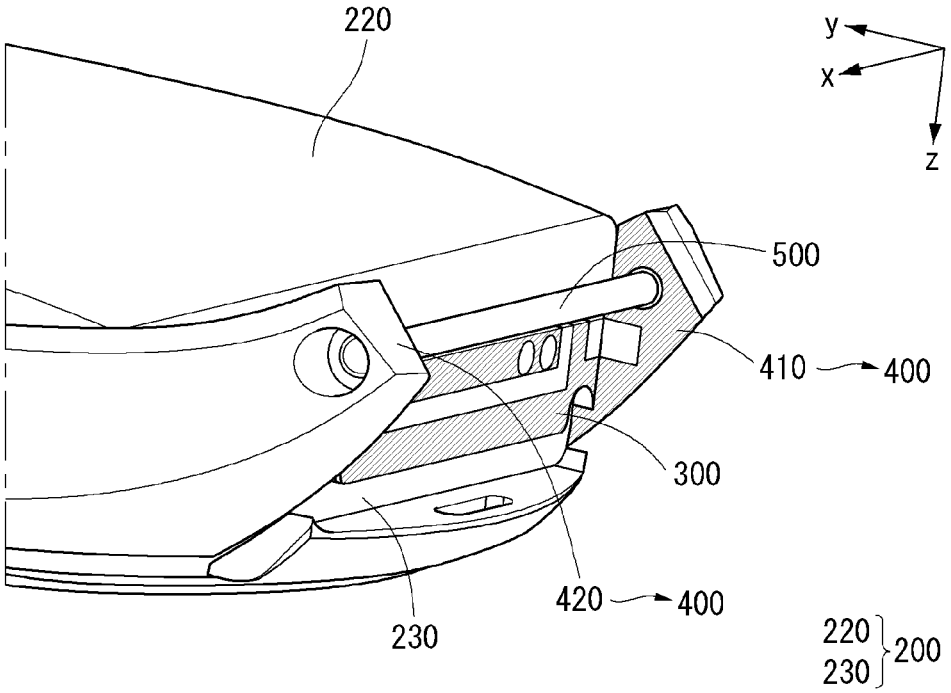
FIG. 6 is a perspective view illustrating a main body of an electronic device according to an embodiment of the invention.

FIG. 6 is a perspective view illustrating the main body of the electronic device according to the embodiment of the invention. More specifically, FIG. 6 illustrates a bottom surface 220 (or a lower surface 220) of the main body 200.

The strap pin connector 400 may include a first strap pin connector 410 and a second strap pin connector 420. The first strap pin connector 410 and the second strap pin connector 420 may be respectively connected to both ends of the strap pin 500. At least one of the first strap pin connector 410 and the second strap pin connector 420 may be electrically connected to the antenna pattern 300.

The strap pin 500 may be physically spaced apart from the main body 200 by the first strap pin connector 410 and the second strap pin connector 420. Because the strap pin 500 is physically spaced apart from the main body 200, a directly electrical connection between the strap pin 500 and the main body 200 may not be formed. The strap pin 500 may be electrically connected to the main body 200 through the strap pin connector 400. For example, the strap pin 500 may be electrically connected to at least one of the first strap pin connector 410 and the second strap pin connector 420.

The antenna pattern 300 may be formed on the side of the main body 200. For example, the antenna pattern 300 may be formed on the side of the main body 200 using the plating. At least a portion of a side surface 230 of the main body 200 may include an insulating portion. In another embodiment, the antenna pattern 300 may be formed on the side of the main body 200 using metal plating. The metal plating may be performed on the outer surface of the main body 200 to form the antenna pattern 300. As shown in FIG. 6, the antenna pattern 300 may be formed on the side of the outer surface of the main body 200, and may be also formed on the upper part and the lower part of the outer surface of the main body 200 as well as the side part of the outer surface of the main body 200. In embodiments disclosed herein, the upper part and the lower part may have different heights with respect to the z-axis.

Figure 7:
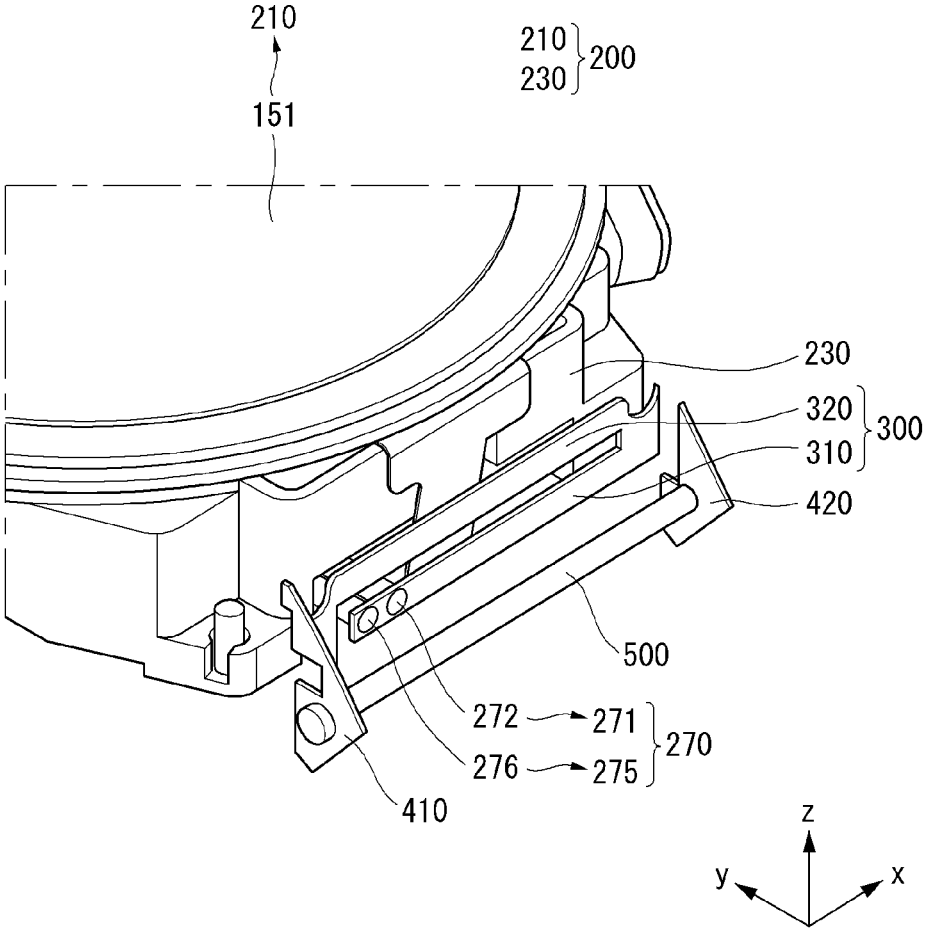
FIG. 7 is a perspective view illustrating an antenna pattern and a strap pin according to an embodiment of the invention.

FIG. 7 is a perspective view illustrating the antenna pattern and the strap pin according to the embodiment of the invention. The electronic device according to the embodiment of the invention may include a pattern connector 270. As shown in FIG. 7, the antenna included in the electronic device according to the embodiment of the invention may be configured as a monopole antenna.

The main body 200 may include an upper surface 210 and a side surface 230. The upper surface 210 may be spaced apart from the lower surface 220 (see FIG. 6) and may be positioned opposite the lower surface 220. The upper surface 210 may include a display unit 151. The side surface 230 may connect the upper surface 210 to the lower surface 220. The upper surface 210, the lower surface 220, and the side surface 230 may form a space inside the main body 200. FIG. 7 illustrates that the pattern connector 270 and the strap pin connector 400 are connected to the antenna pattern 300, but a portion of the side surface 230 is omitted in FIG. 7 for convenience of explanation.

The pattern connector 270 may be mounted on the main body 200 and may electrically connect the wireless communication unit 110 to the antenna pattern 300. The pattern connector 270 may include a first antenna feeder 271 and a second antenna feeder 275.

The first antenna feeder 271 may be electrically connected to the antenna pattern 300 and may transmit an electrical signal to the antenna pattern 300 or receive the electrical signal from the antenna pattern 300. The first antenna feeder 271 may include a first antenna feeder connector 272 connected to the antenna pattern 300.

The second antenna feeder 275 may be electrically connected to the antenna pattern 300 and may transmit an electrical signal to the antenna pattern 300 or receive the electrical signal from the antenna pattern 300. The second antenna feeder 275 may form a potential that is a reference with respect to the first antenna feeder 271. Namely, the second antenna feeder 275 may be earthed or grounded. The second antenna feeder 275 may include a second antenna feeder connector 276 connected to the antenna pattern 300.

The antenna pattern 300 may include a first antenna pattern portion 310 and a second antenna pattern portion 320. The antenna pattern 300 may be formed in the insulating portion (i.e., a portion that is electrically insulated) of the side surface 230 of the main body 200. For example, the antenna pattern 300 may be formed by performing the plating processing on the side surface 230 or attaching a conductive strip to the side surface 230. It may be preferable, but not required, the side surface 230, on which that the antenna pattern 300 is positioned, is electrically insulated.

The first antenna pattern portion 310 may be electrically connected to the pattern connector 270, and the wireless communication unit 110 may be electrically connected to the pattern connector 270. Thus, the first antenna pattern portion 310 may be electrically connected to the wireless communication unit 110. As shown in FIG. 7, the first antenna pattern portion 310 may be formed in a shape of a line segment. The first antenna pattern portion 310 may be substantially parallel to the strap pin 500. The first antenna pattern portion 310 may be spaced apart from the upper surface 210 by a predetermined distance.

The second antenna pattern portion 320 may be spaced apart from the first antenna pattern portion 310, but one end of the second antenna pattern portion 320 may be connected to the first antenna pattern portion 310. The other end of the second antenna pattern portion 320 may be connected to the strap pin connector 400. For example, one end of the second antenna pattern portion 320 may be electrically connected to the first strap pin connector 410. As shown in FIG. 7, the second antenna pattern portion 320 may be formed in a shape of a line segment. The second antenna pattern portion 320 may be substantially parallel to the strap pin 500. Further, the second antenna pattern portion 320 may be substantially parallel to the first antenna pattern portion 310.

The first and second antenna pattern portions 310 and 320 may be at different locations on the z-axis. For example, when a location on the z-axis is regarded as a height, the second antenna pattern portion 320 may be at a location higher than the first antenna pattern portion 310. Because the upper surface 210 may be substantially parallel to x-y plane (formed by the x-axis and the y-axis), a distance between the second antenna pattern portion 320 and the upper surface 210 may be shorter than a distance between the first antenna pattern portion 310 and the upper surface 210. Because the lower surface 220 (see FIG. 6) may be positioned opposite the upper surface 210, the lower surface 220 may be substantially parallel to the x-y plane and may be at a location lower than the upper surface 210. Namely, a distance between the second antenna pattern portion 320 and the lower surface 220 may be longer than a distance between the first antenna pattern portion 310 and the lower surface 220.

When a distance between the first antenna pattern portion 310 and the lower surface 220 is shorter than a distance between the second antenna pattern portion 320 and the lower surface 220 (namely, when the lower surface 220 is closer to the first antenna pattern portion 310 than the second antenna pattern portion 320), the first antenna pattern portion 310 may be regarded as being at a first location. For example, in FIG. 7, the first antenna pattern portion 310 may be regarded as being at the first location. Further, when a distance between the first antenna pattern portion 310 and the lower surface 220 is longer than a distance between the second antenna pattern portion 320 and the lower surface 220 (namely, when the lower surface 220 is closer to the second antenna pattern portion 320 than the first antenna pattern portion 310), the first antenna pattern portion 310 may be regarded as being at a second location.

In other words, the first and second antenna pattern portions 310 and 320 may be spaced apart from each other and may have a stratified structure in the height direction (or the z-axis direction). When the first antenna pattern portion 310 is at a location lower than the second antenna pattern portion 320 on the basis of the lower surface 220, the first antenna pattern portion 310 may be at the first location. When the first antenna pattern portion 310 is at a location higher than the second antenna pattern portion 320 on the basis of the lower surface 220, the first antenna pattern portion 310 may be at the second location.

The first antenna feeder connector 272 and the second antenna feeder connector 276 may be connected to the first antenna pattern portion 310. A line segment connecting the first antenna feeder connector 272 to the second antenna feeder connector 276 may be substantially parallel to at least one of the upper surface 210, the lower surface 220, the first antenna pattern portion 310, the second antenna pattern portion 320, and the strap pin 500. For example, the line segment connecting the first antenna feeder connector 272 to the second antenna feeder connector 276 may be substantially parallel to the strap pin 500.

Referring to FIG. 7, an electrical signal received from the wireless communication unit 110 may be transferred to the first antenna pattern portion 310 via the pattern connector 270. The electrical signal transferred to the first antenna pattern portion 310 may be transferred to the strap pin 500 via the second antenna pattern portion 320 and the first strap pin connector 410. At least one of the antenna pattern 300, the first strap pin connector 410, and the strap pin 500, that receive the electrical signal, may generate radio waves. For example, the first antenna pattern portion 310, the second antenna pattern portion 320, and the strap pin 500, that receive the electrical signal, may transmit the radio waves.

A process for receiving radio waves may be performed in reverse order of the process for transmitting the radio waves. For example, at least one of the first antenna pattern portion 310, the second antenna pattern portion 320, and the strap pin 500 may generate an electrical signal in response to the radio waves, and the electrical signal may be transferred to the wireless communication unit 110 via the pattern connector 270.

Figure 8:
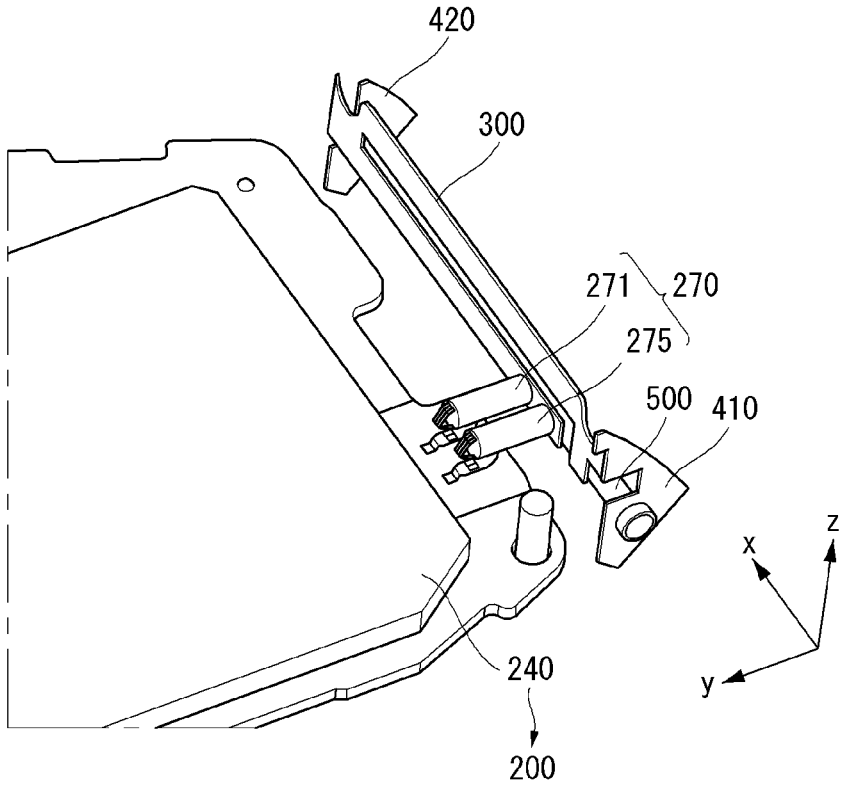
FIG. 8 illustrates a connection of a printed circuit board (PCB), a pattern connector, and an antenna pattern in accordance with an embodiment of the invention.

FIG. 8 illustrates a connection of a printed circuit board, a pattern connector, and an antenna pattern in accordance with the embodiment of the invention.

The main body 200 may include the PCB 240. The wireless communication unit 110 (see FIG. 1) and the controller 180 (see FIG. 1) may be mounted on the PCB 240. The PCB 240 may be positioned inside the main body 200.

The pattern connector 270 may be connected to the PCB 240. The first antenna feeder 271 and the second antenna feeder 272 may be formed in a press-fit pin manner and connected to the PCB 240. The PCB 240 may be provided with a terminal corresponding to a press-fit pin.

The antenna pattern 300 may electrically connect the pattern connector 270 to the first strap pin connector 410. The first strap pin connector 410 may electrically connect the pattern connector 270 to the strap pin 500. Thus, an electrical signal generated in the wireless communication unit 110 may be transferred to the strap pin 500 via the pattern connector 270 and the antenna pattern 300. At least one of the antenna pattern 300, the first strap pin connector 410, and the strap pin 500 may convert the electrical signal into radio waves.

Figure 9:
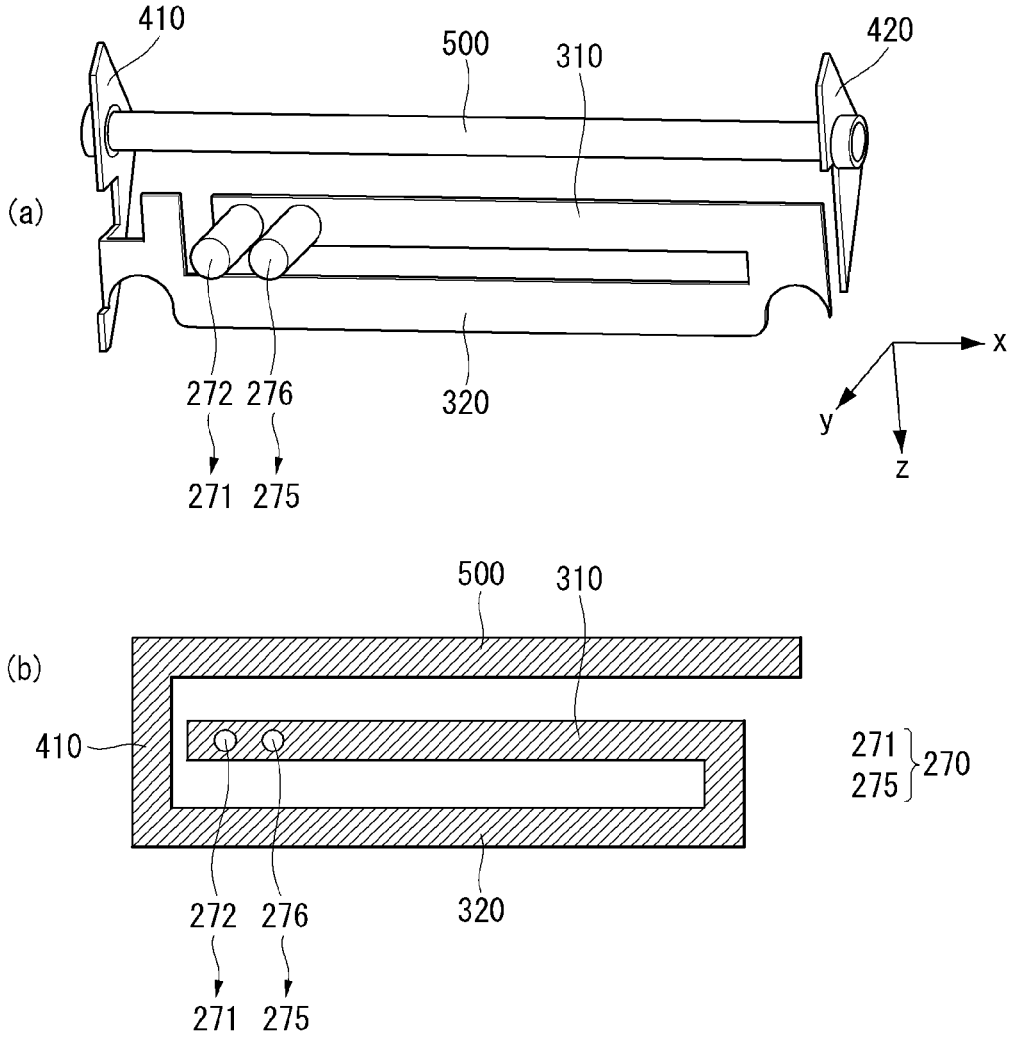
FIGS. 9 to 17 illustrate various examples of a connection of a pattern connector, an antenna pattern, and a strap pin according to an embodiment of the invention.

In FIG. 9, (a) illustrates a connection of a pattern connector, an antenna pattern, and a strap pin according to the embodiment of the invention, and (b) is a diagram illustrating an electrical connection shown in (a) of FIG. 9.

As shown in (a) of FIG. 9, the first strap pin connector 410 and the second strap pin connector 420 may be physically connected to both ends of the strap pin 500. The first strap pin connector 410 may be electrically connected to one end of the strap pin 500.

As shown in (a) of FIG. 9, the first strap pin connector 410 and the first antenna pattern portion 310 may be electrically connected to both ends of the second antenna pattern portion 320, respectively. At least a portion of the second antenna pattern portion 320 may have a shape of a line segment. The second antenna pattern portion 320 may be substantially parallel to the strap pin 500.

As shown in (a) of FIG. 9, the pattern connector 270 and the second antenna pattern portion 320 may be connected to both ends of the first antenna pattern portion 310, respectively. At least a portion of the first antenna pattern portion 310 may have a shape of a line segment. The first antenna pattern portion 310 may be substantially parallel to the strap pin 500.

As shown in (b) of FIG. 9, a line segment connecting the first antenna feeder connector 272 to the second antenna feeder connector 276 may be substantially parallel to at least one of the first antenna pattern portion 310, the second antenna pattern portion 320, and the strap pin 500.

Figure 10:
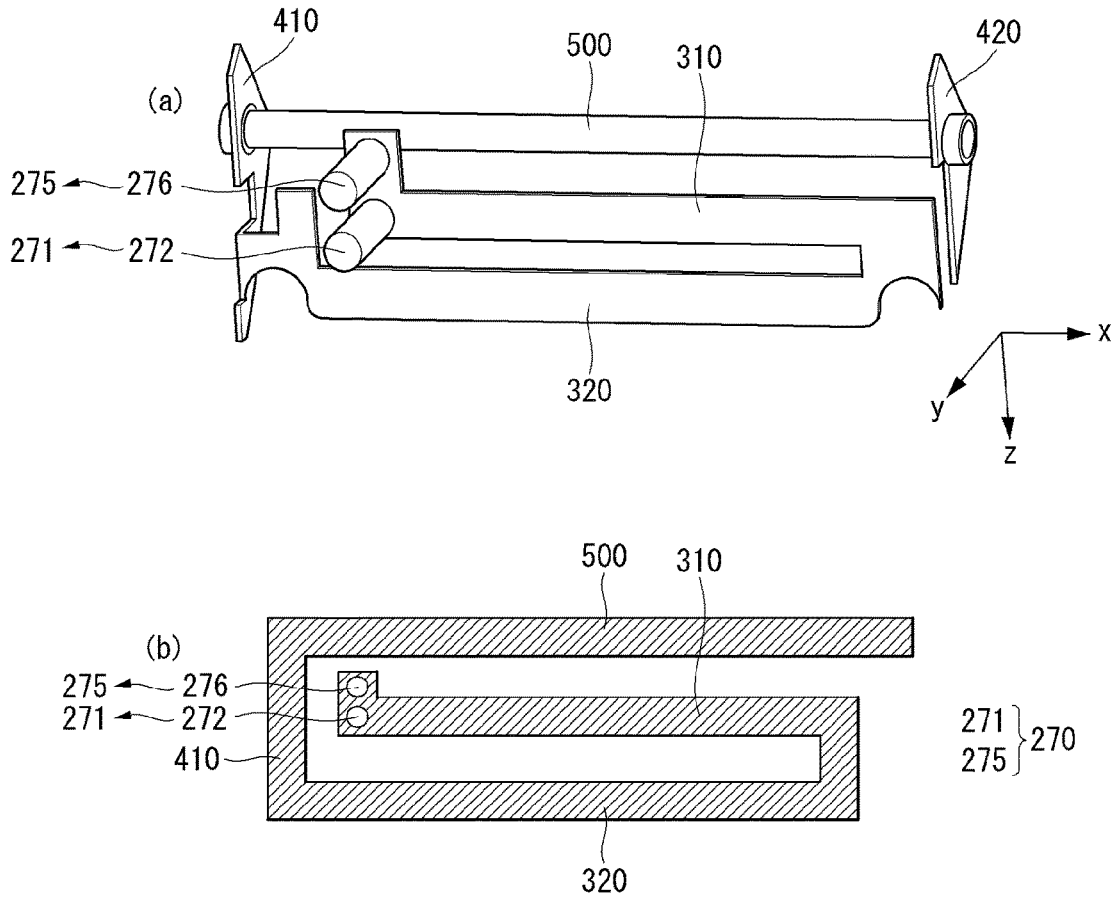

In FIG. 10, (a) illustrates a connection of a pattern connector, an antenna pattern, and a strap pin according to the embodiment of the invention, and (b) is a diagram illustrating an electrical connection shown in (a) of FIG. 10.

As shown in (a) of FIG. 10, the first strap pin connector 410 and the second strap pin connector 420 may be physically connected to both ends of the strap pin 500. The first strap pin connector 410 may be electrically connected to one end of the strap pin 500.

As shown in (a) of FIG. 10, the first strap pin connector 410 and the first antenna pattern portion 310 may be electrically connected to both ends of the second antenna pattern portion 320, respectively. At least a portion of the second antenna pattern portion 320 may have a shape of a line segment. The second antenna pattern portion 320 may be substantially parallel to the strap pin 500.

As shown in (a) of FIG. 10, the pattern connector 270 and the second antenna pattern portion 320 may be connected to both ends of the first antenna pattern portion 310, respectively. At least a portion of the first antenna pattern portion 310 may have a shape of a line segment. The first antenna pattern portion 310 may be substantially parallel to the strap pin 500.

As shown in (b) of FIG. 10, a line segment connecting the first antenna feeder connector 272 to the second antenna feeder connector 276 may be substantially vertical to at least one of the first antenna pattern portion 310, the second antenna pattern portion 320, and the strap pin 500. For example, the line segment connecting the first antenna feeder connector 272 to the second antenna feeder connector 276 may be vertical to the strap pin 500. When the line segment connecting the first antenna feeder connector 272 to the second antenna feeder connector 276 is vertical to the strap pin 500 as describe above, a position shape of the pattern connector 270 inside the main body 200 (see FIG. 8) may be different from a position shape shown in FIG. 8. Thus, an inner space of the main body 200 may be variously used.

Figure 11:
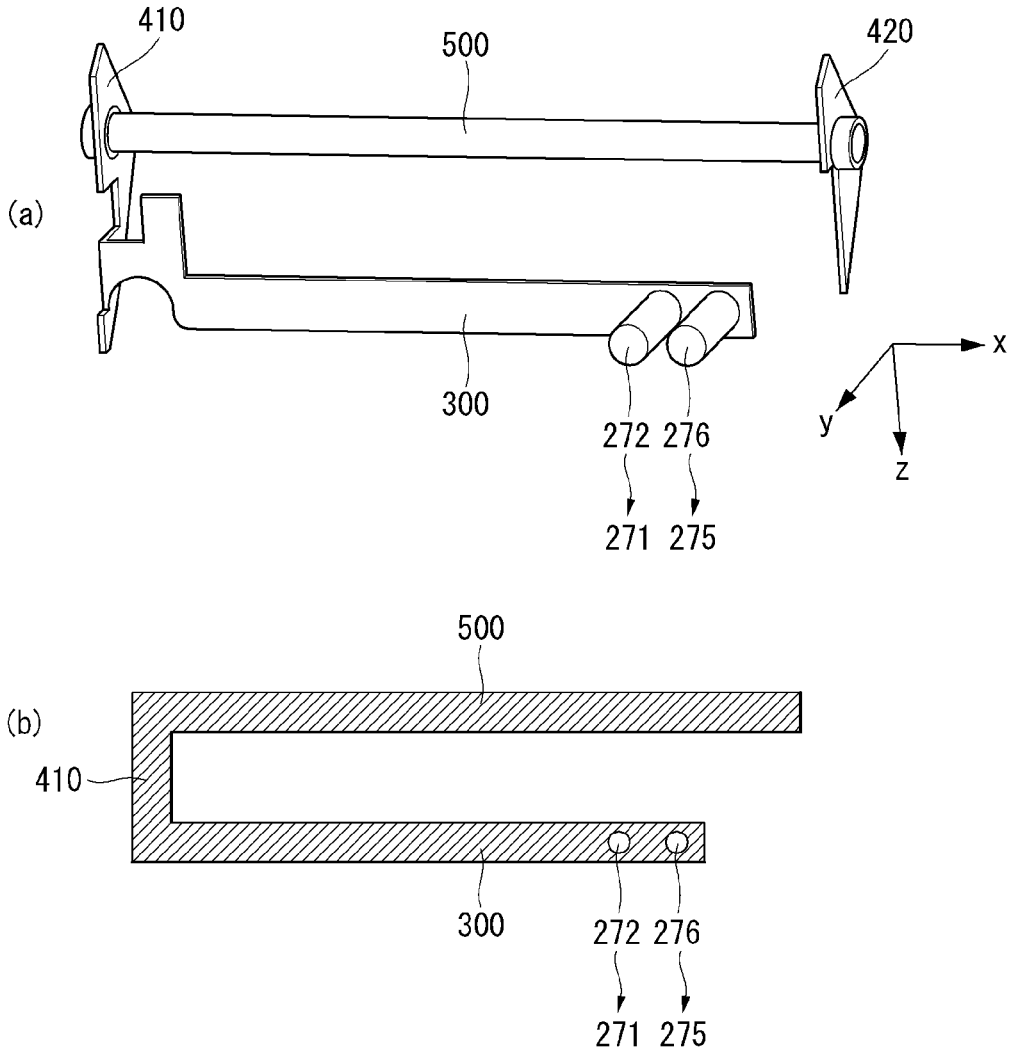

In FIG. 11, (a) illustrates a connection of a pattern connector, an antenna pattern, and a strap pin according to the embodiment of the invention, and (b) is a diagram illustrating an electrical connection shown in (a) of FIG. 11.

As shown in (a) of FIG. 11, the first strap pin connector 410 and the second strap pin connector 420 may be physically connected to both ends of the strap pin 500. The first strap pin connector 410 may be electrically connected to one end of the strap pin 500.

As shown in (a) of FIG. 11, the pattern connector 270 and the first strap pin connector 410 may be connected to both ends of the antenna pattern 300, respectively. At least a portion of the antenna pattern 300 may have a shape of a line segment. The antenna pattern 300 may be substantially parallel to the strap pin 500.

As shown in (b) of FIG. 11, a line segment connecting the first antenna feeder connector 272 to the second antenna feeder connector 276 may be substantially parallel to at least one of the antenna pattern 300 and the strap pin 500.

Figure 12:
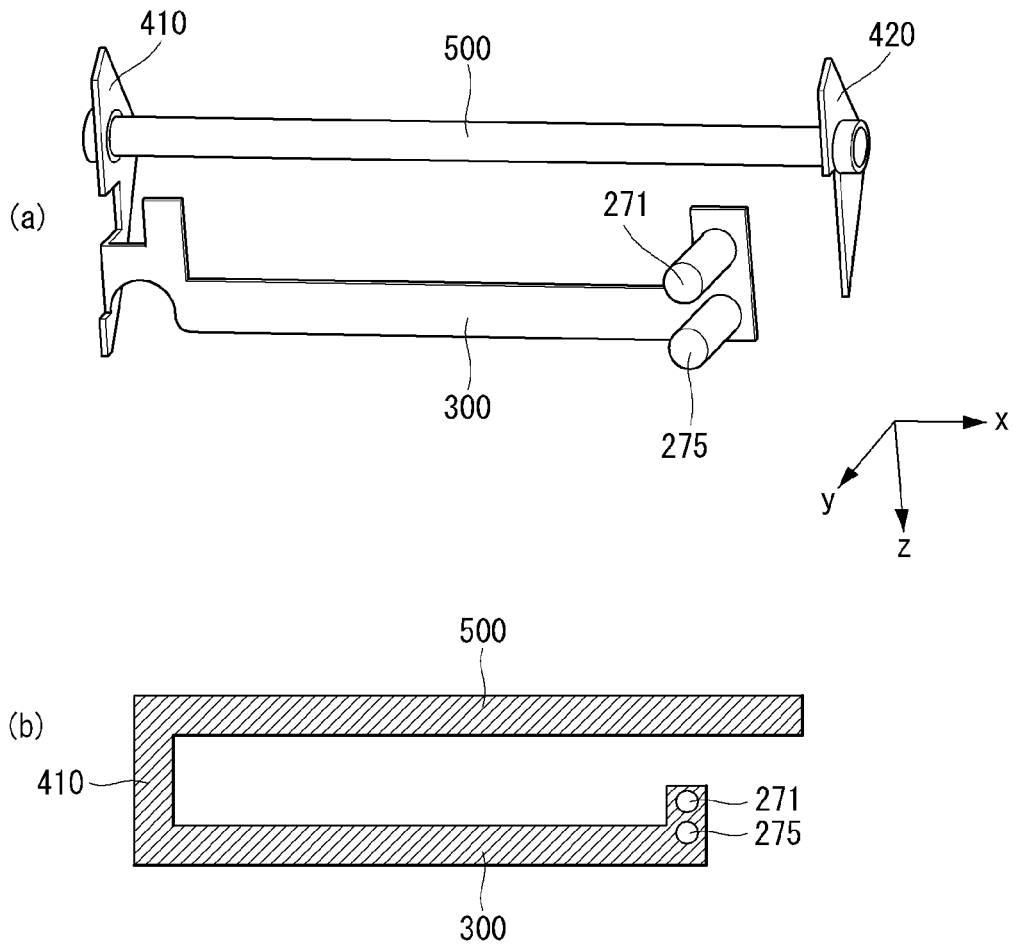

In FIG. 12, (a) illustrates a connection of a pattern connector, an antenna pattern, and a strap pin according to the embodiment of the invention, and (b) is a diagram illustrating an electrical connection shown in (a) of FIG. 12.

As shown in (a) of FIG. 12, the first strap pin connector 410 and the second strap pin connector 420 may be physically connected to both ends of the strap pin 500. The first strap pin connector 410 may be electrically connected to one end of the strap pin 500.

As shown in (a) of FIG. 12, the pattern connector 270 and the first strap pin connector 410 may be connected to both ends of the antenna pattern 300, respectively. At least a portion of the antenna pattern 300 may have a shape of a line segment. The antenna pattern 300 may be substantially parallel to the strap pin 500.

As shown in (b) of FIG. 12, a line segment connecting the first antenna feeder connector 272 to the second antenna feeder connector 276 may be substantially vertical to at least one of the antenna pattern 300 and the strap pin 500. For example, the line segment connecting the first antenna feeder connector 272 to the second antenna feeder connector 276 may be substantially vertical to the antenna pattern 300.

Figure 13:
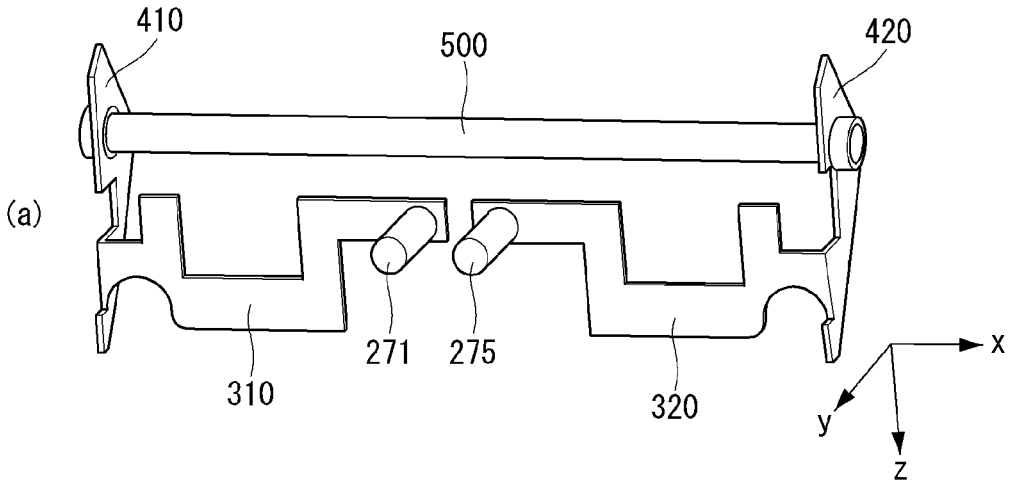
Figure 13:
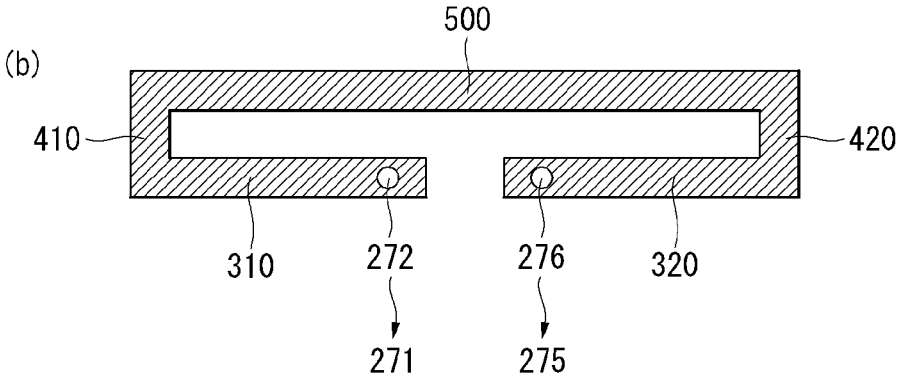

In FIG. 13, (a) illustrates a connection of a pattern connector, an antenna pattern, and a strap pin according to the embodiment of the invention, and (b) is a diagram illustrating an electrical connection shown in (a) of FIG. 13. As shown in FIG. 13, the antenna included in the electronic device according to the embodiment of the invention may be configured as a loop antenna.

The first strap pin connector 410 and the second strap pin connector 420 may be respectively connected to both ends of the strap pin 500. The first strap pin connector 410 may connect the strap pin 500 to the first antenna pattern portion 310, and the second strap pin connector 420 may connect the strap pin 500 to the second antenna pattern portion 320.

The first strap pin connector 410 and the first antenna feeder 271 may be respectively connected to both ends of the first antenna pattern portion 310. At least a portion of the first antenna pattern portion 310 may be formed in a shape of a line segment substantially parallel to the strap pin 500.

The second strap pin connector 420 and the second antenna feeder 275 may be respectively connected to both ends of the second antenna pattern portion 320. At least a portion of the second antenna pattern portion 320 may be formed in a shape of a line segment substantially parallel to the strap pin 500. The second antenna pattern portion 320 may be spaced apart from the first antenna pattern portion 310.

As shown in (b) of FIG. 13, a line segment connecting the first antenna feeder connector 272 to the second antenna feeder connector 276 may be substantially parallel to the strap pin 500.

A process for transferring an electrical signal in the electronic device according to the embodiment of the invention is described below. An electrical signal generated in the wireless communication unit 110 may be transferred to the first antenna feeder 271 and the second antenna feeder 275. The electrical signal transferred to the first antenna feeder 271 may be transferred to the strap pin 500 via the first antenna pattern portion 310 and the first strap pin connector 410. The electrical signal transferred to the second antenna feeder 275 may be transferred to the strap pin 500 via the second antenna pattern portion 320 and the second strap pin connector 420. As shown in (b) of FIG. 13, the first antenna feeder 271, the first antenna pattern portion 310, the first strap pin connector 410, the strap pin 500, the second strap pin connector 420, the second antenna pattern portion 320, and the second antenna feeder 275 may be electrically connected to one another in the order named or in reverse order.

Figure 14:
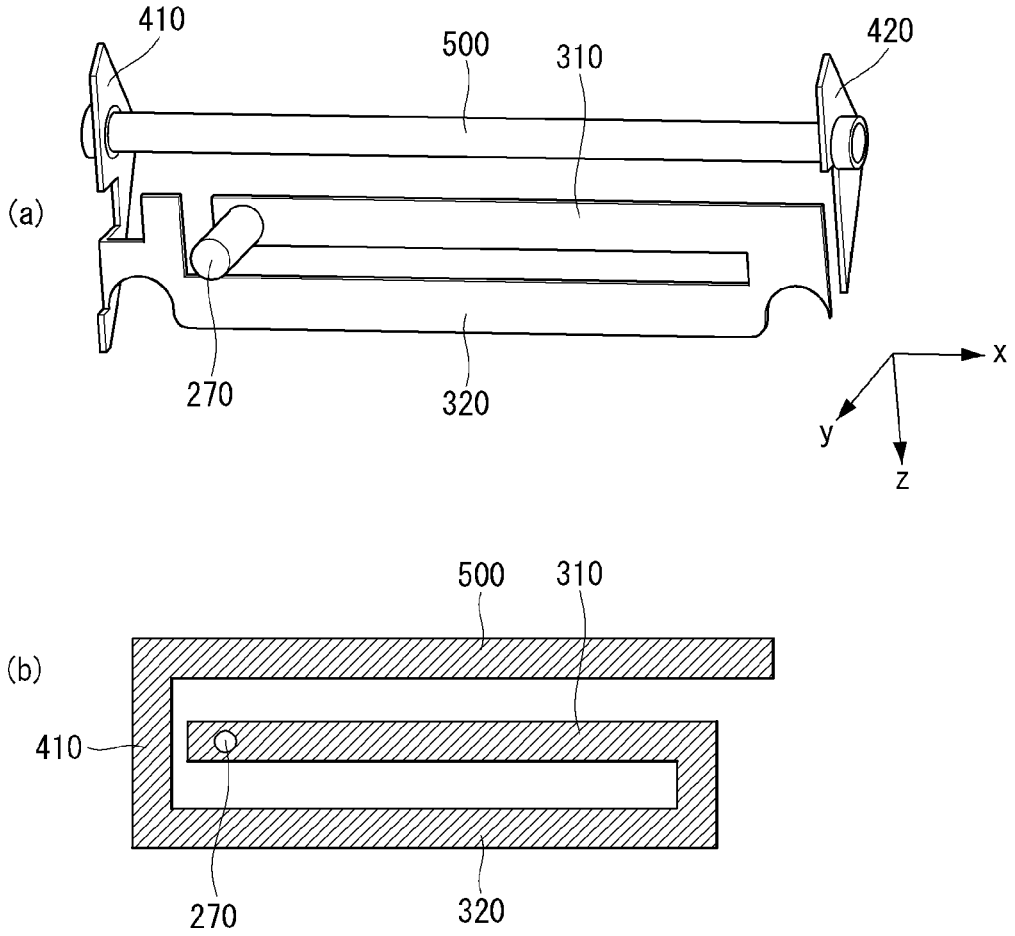

In FIG. 14, (a) illustrates a connection of a pattern connector, an antenna pattern, and a strap pin according to the embodiment of the invention, and (b) is a diagram illustrating an electrical connection shown in (a) of FIG. 14.

The pattern connector 270 may include the first antenna feeder 271. The first antenna feeder 271 may be electrically connected to the first antenna pattern portion 310. The first antenna feeder 271 may transfer an electrical signal to the first antenna pattern portion 310. A reference potential of the electrical signal transferred by the first antenna feeder 271 may be set by the PCB 240 (see FIG. 8). Namely, the inside of the main body 200 (see FIG. 7) may be earthed or grounded. The structural stability of the electronic device according to the embodiment of the invention can be anticipated by simplifying a structure of the pattern connector 270 contacting the antenna pattern 300.

As shown in (a) of FIG. 14, the first antenna feeder 271 and the second antenna pattern portion 320 may be connected to both ends of the first antenna pattern portion 310. The first antenna pattern portion 310 and the first strap pin connector 410 may be connected to both ends of the second antenna pattern portion 320. The first strap pin connector 410 may connect the second antenna pattern portion 320 to the strap pin 500.

As shown in (b) of FIG. 14, the electrical signal may be transferred along the first antenna feeder 271, the first antenna pattern portion 310, the second antenna pattern portion 320, the first strap pin connector 410, and the strap pin 500. At least one of the first antenna pattern portion 310, the second antenna pattern portion 320, the first strap pin connector 410, and the strap pin 500 may convert the received electrical signal into radio waves and transmit the radio waves. From a point of view of the reception of radio waves, at least one of the first antenna pattern portion 310, the second antenna pattern portion 320, the first strap pin connector 410, and the strap pin 500 may receive radio waves, convert the radio waves into an electrical signal, and transmit the electrical signal to the wireless communication unit 110.

Figure 15:
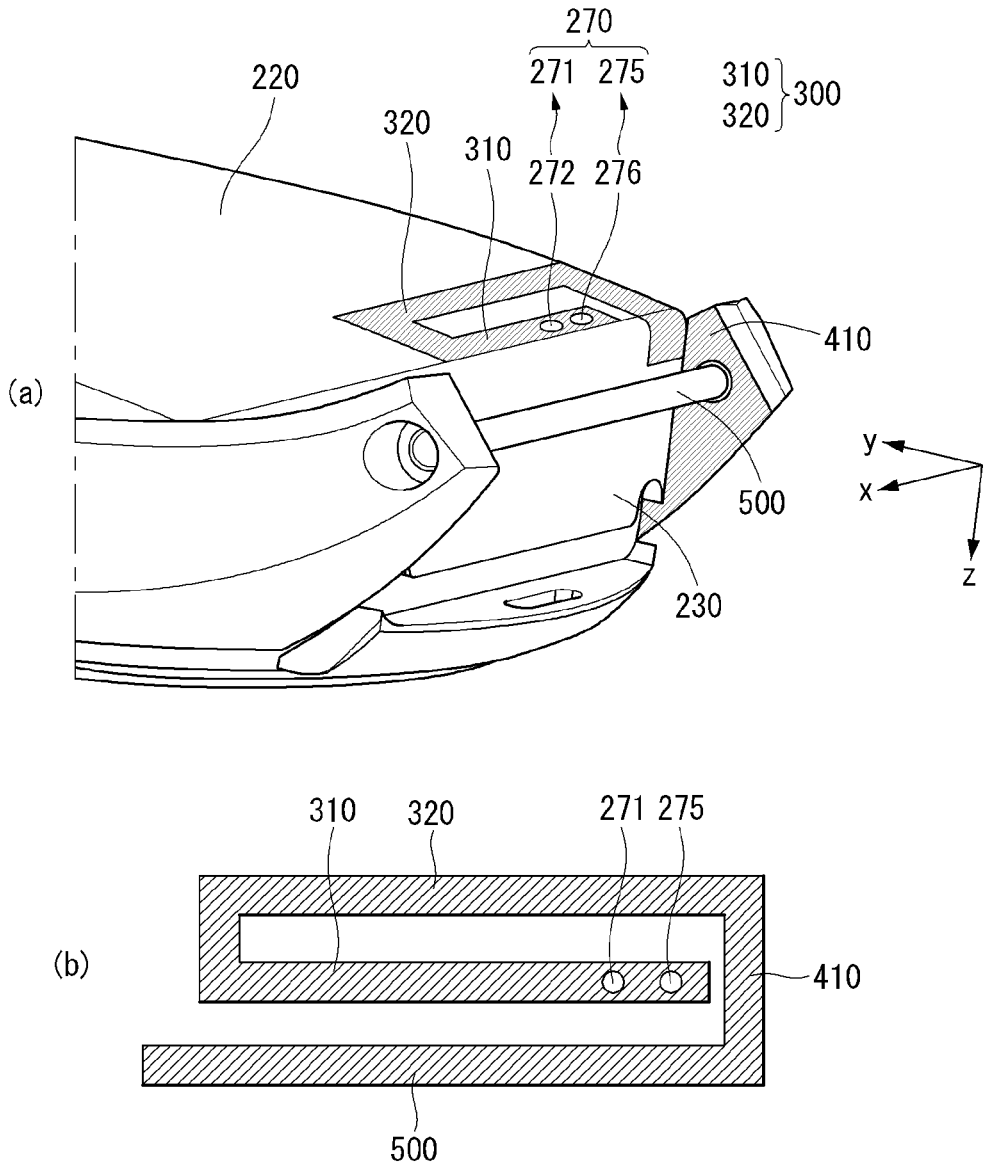

In FIG. 15, (a) illustrates a connection of a pattern connector, an antenna pattern, and a strap pin according to the embodiment of the invention, and (b) is a diagram illustrating an electrical connection shown in (a) of FIG. 15.

An antenna pattern 300 may be formed on the lower surface 220. The electronic device according to the embodiment of the invention may be designed to have the side surface 230 of a small area. In this instance, it may be difficult to form the antenna pattern 300 on the side surface 230. Thus, the antenna pattern 300 may be formed on the lower surface 220.

The antenna pattern 300 may include a first antenna pattern portion 310 and a second antenna pattern portion 320. The pattern connector 270 may be connected to one end of the first antenna pattern portion 310. The second antenna pattern portion 320 may connect the first antenna pattern portion 310 to the first strap pin connector 410.

The pattern connector 270 may include a first antenna feeder 271 and a second antenna feeder 275. A first antenna feeder connector 272 and a second antenna feeder connector 276 may be connected to the first antenna pattern portion 310. A line segment connecting the first antenna feeder connector 272 to the second antenna feeder connector 276 may be substantially parallel to at least one of the first antenna pattern portion 310, the second antenna pattern portion 320, and the strap pin 500.

As shown in (b) of FIG. 15, the pattern connector 270, the first antenna pattern portion 310, the second antenna pattern portion 320, the first strap pin connector 410, and the strap pin 500 may be electrically connected to one another in the order named.

Figure 16:
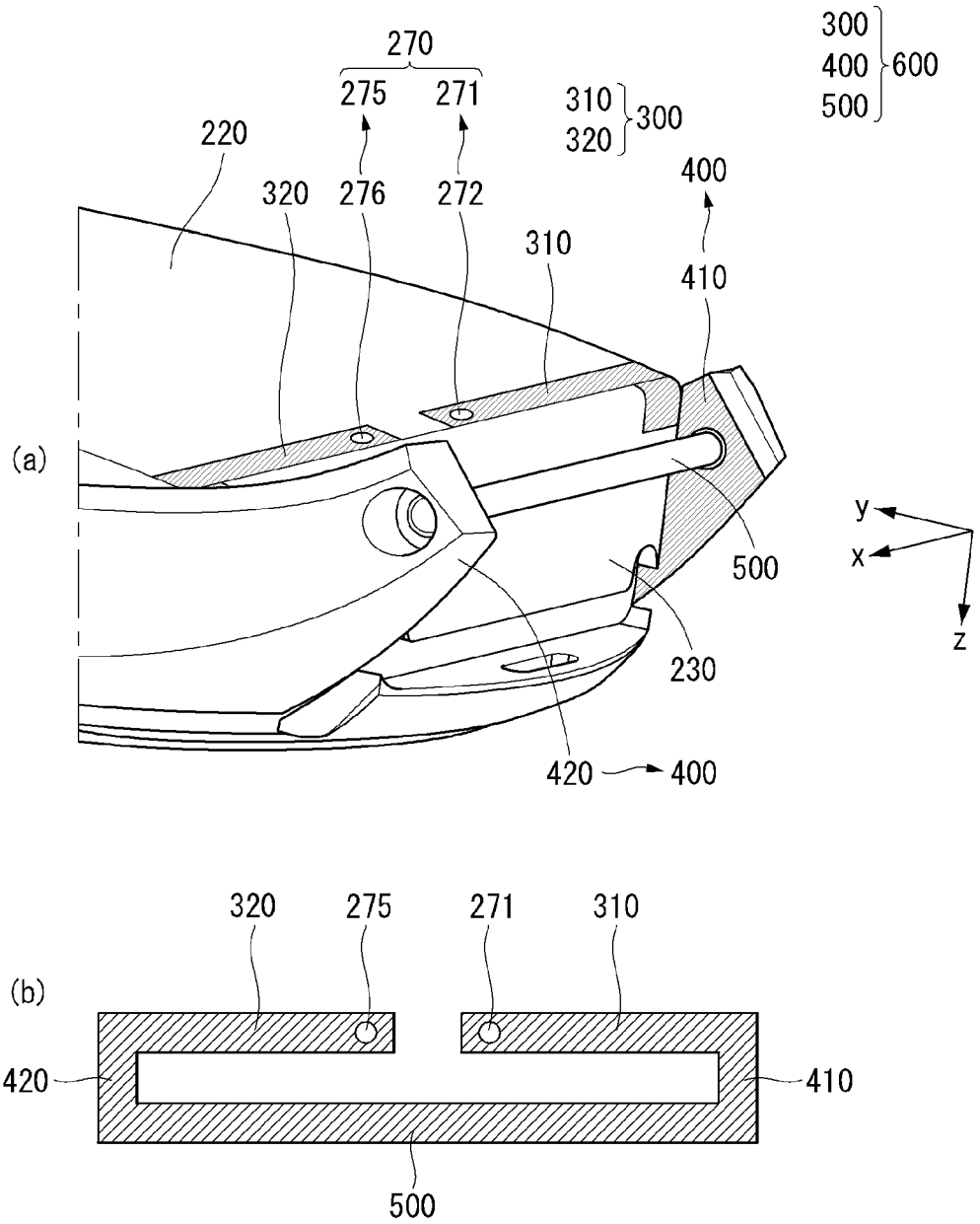

In FIG. 16, (a) illustrates a connection of a pattern connector, an antenna pattern, and a strap pin according to the embodiment of the invention, and (b) is a diagram illustrating an electrical connection shown in (a) of FIG. 16.

As shown in (a) of FIG. 16, an antenna 600 included in the electronic device according to the embodiment of the invention may include an antenna pattern 300, a strap pin connector 400, and a strap pin 500. As shown in FIG. 16, the antenna 600 may be configured as a loop antenna.

The antenna pattern 300 may be formed on the lower surface 220. The antenna pattern 300 may include a first antenna pattern portion 310 and a second antenna pattern portion 320. The first antenna pattern portion 310 may connect a first antenna feeder 271 to a first strap pin connector 410. The second antenna pattern portion 320 may connect a second antenna feeder 275 to a second strap pin connector 420.

The strap pin 500 may connect the first strap pin connector 410 to the second strap pin connector 420. As shown in (b) of FIG. 16, the first antenna feeder 271, the first antenna pattern portion 310, the first strap pin connector 410, the strap pin 500, the second strap pin connector 420, the second antenna pattern portion 320, and the second antenna feeder 275 may be electrically connected to one another in the order named or in reverse order. A first antenna feeder connector 272 and a second antenna feeder connector 276 may be spaced apart from each other.

Figure 17:
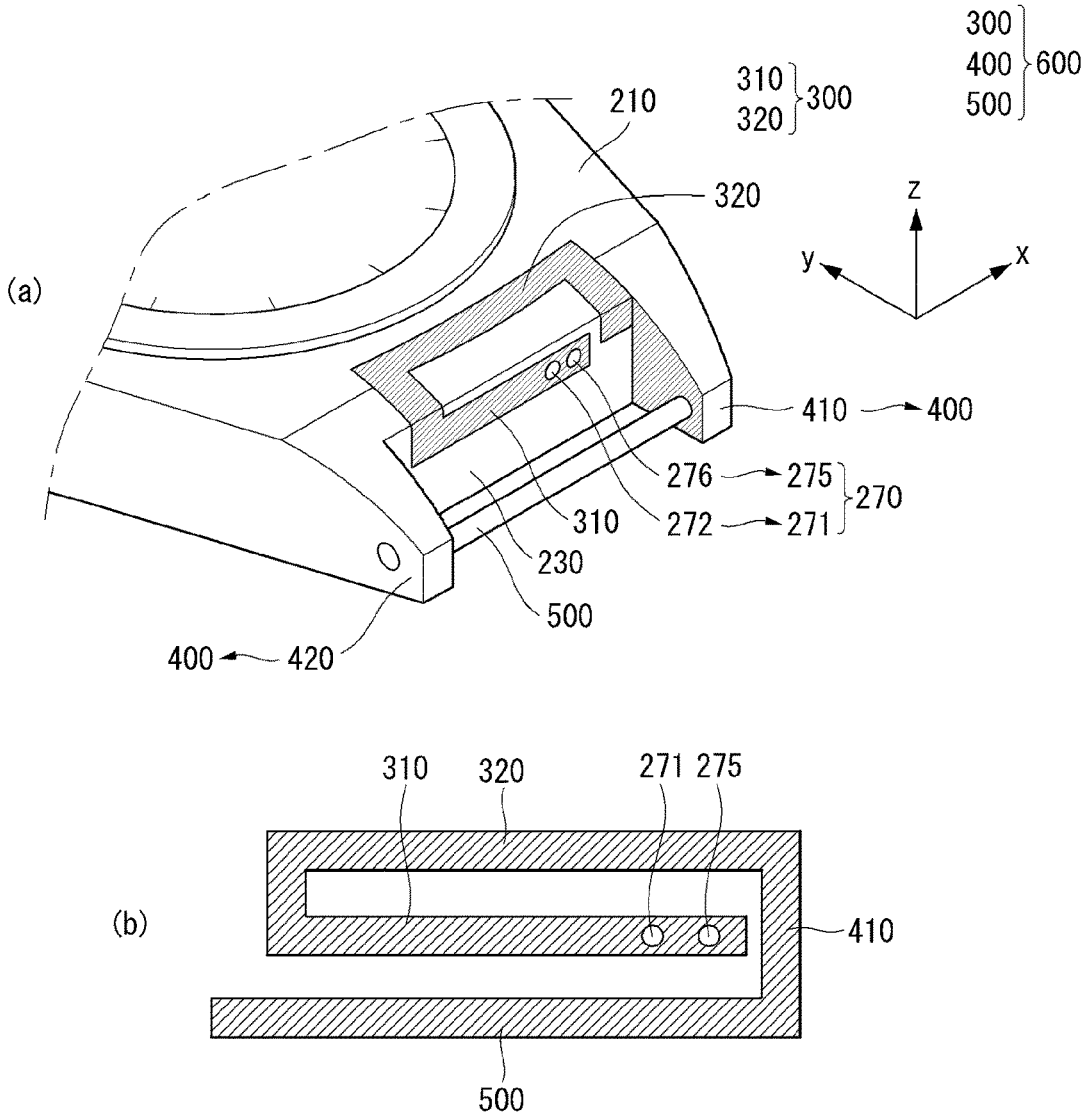

In FIG. 17, (a) illustrates a connection of a pattern connector, an antenna pattern, and a strap pin according to the embodiment of the invention, and (b) is a diagram illustrating an electrical connection shown in (a) of FIG. 17.

As shown in (a) of FIG. 17, the antenna pattern 300 may include a first antenna pattern portion 310 and a second antenna pattern portion 320. The first antenna pattern portion 310 may be formed on the side surface 230. The second antenna pattern portion 320 may be formed on the upper surface 210. Namely, the first antenna pattern portion 310 and the second antenna pattern portion 320 may be formed in different areas.

Because the first antenna pattern portion 310 and the second antenna pattern portion 320 are provided, a length of the antenna 600 may be secured. Because the second antenna pattern portion 320 may be formed on the upper surface 210, radio waves can be efficiently radiated. Further, because the second antenna pattern portion 320 may be formed on the upper surface 210, the side surface 230 can be efficiently used. The electronic device may be designed thinly in the height direction (or the z-axis direction).

The first antenna pattern portion 310 may connect a pattern connector 270 to the second antenna pattern portion 320. The second antenna pattern portion 320 may connect the first antenna pattern portion 310 to a first strap pin connector 410. The first strap pin connector 410 may connect the second antenna pattern portion 320 to a strap pin 500. As shown in (b) of FIG. 17, the pattern connector 270, the first antenna pattern portion 310, the second antenna pattern portion 320, the first strap pin connector 410, and the strap pin 500 may be electrically connected to one another in the order named or in reverse order.

Figure 18:
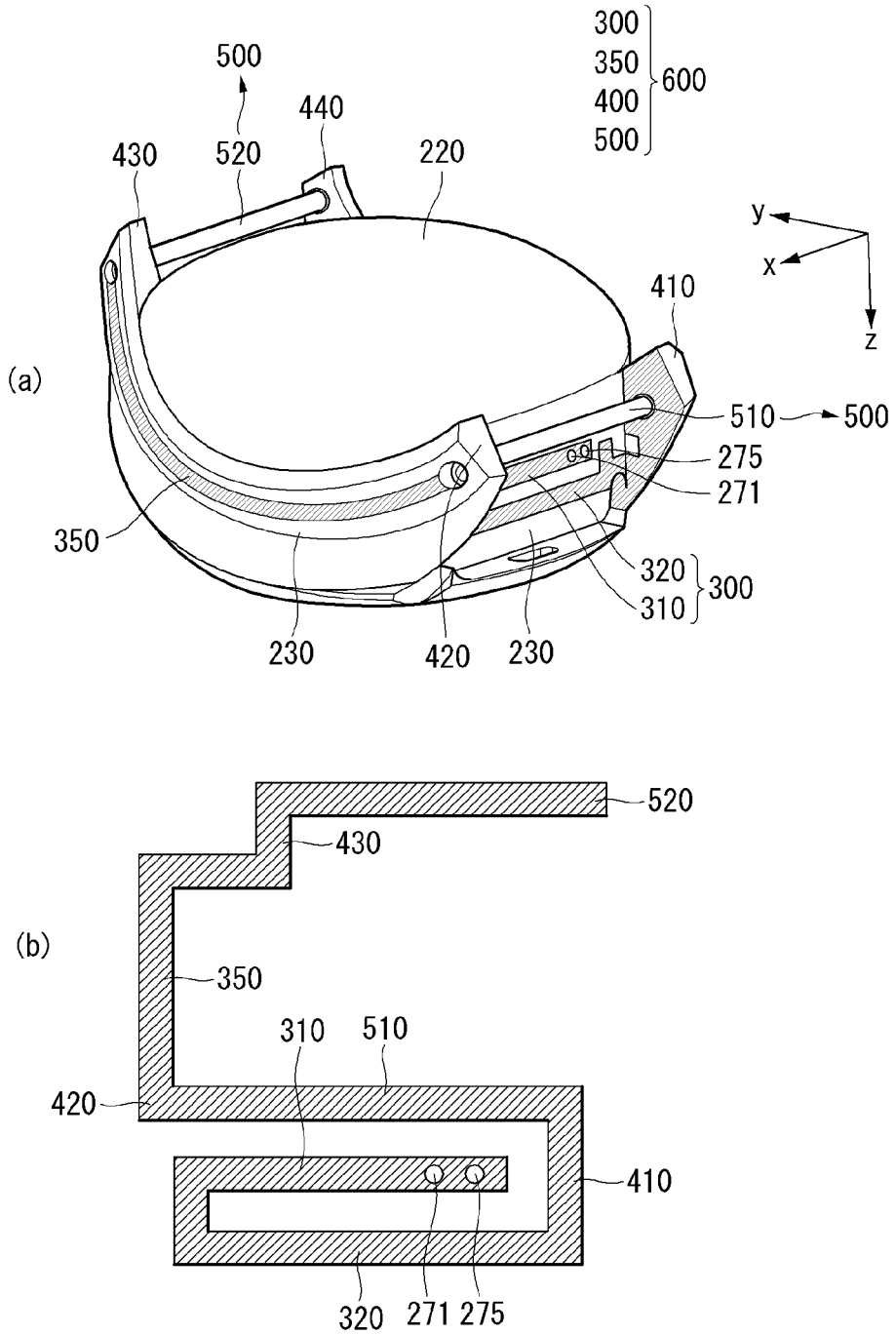
FIGS. 18 and 19 illustrate an extended antenna pattern according to an embodiment of the invention.

In FIG. 18, (a) illustrates an extended antenna pattern according to the embodiment of the invention, and (b) is a diagram illustrating an electrical connection shown in (a) of FIG. 18.

As shown in FIG. 18, an antenna 600 according to the embodiment of the invention may include an extended antenna pattern 350. In other words, the antenna 600 may include an antenna pattern 300, a strap pin connector 400, a strap pin 500, and the extended antenna pattern 350.

A plurality of strap pin connectors 400 may be provided. Namely, the plurality of strap pin connectors 400 may include a first strap pin connector 410, a second strap pin connector 420, a third strap pin connector 430, and a fourth strap pin connector 440. A plurality of strap pins 500 may be provided. Namely, the plurality of strap pins 500 may include a first strap pin 510 and a second strap pin 520. The first strap pin connector 410 and the second strap pin connector 420 may support the first strap pin 510, and the third strap pin connector 430 and the fourth strap pin connector 440 may support the second strap pin 520.

A first antenna pattern portion 310 may connect a pattern connector 270 to a second antenna pattern portion 320. The second antenna pattern portion 320 may connect the first antenna pattern portion 310 to the first strap pin connector 410. The first strap pin connector 410 may connect the second antenna pattern portion 320 to the first strap pin 510. The first strap pin 510 may connect the first strap pin connector 410 to the second strap pin connector 420. The second strap pin connector 420 may connect the first strap pin 510 to the extended antenna pattern 350. The extended antenna pattern 350 may connect the second strap pin connector 420 to the third strap pin connector 430. The third strap pin connector 430 may connect the extended antenna pattern 350 to the second strap pin 520.

As shown in (b) of FIG. 18, the pattern connector 270, the first antenna pattern portion 310, the second antenna pattern portion 320, the first strap pin connector 410, the first strap pin 510, the second strap pin connector 420, the extended antenna pattern 350, the third strap pin connector 430, and the second strap pin 520 may be electrically connected to one another in the order named or in reverse order.

Because the extended antenna pattern 350 and the second strap pin 520 are included in the antenna 600, a length of the antenna 600 can be sufficiently secured. As shown in (a) of FIG. 18, the extended antenna pattern 350 may be formed on the side surface 230. Alternatively, the extended antenna pattern 350 may be formed on the upper surface 210 (see FIG. 7) and/or the lower surface 220, if necessary or desired.

Figure 19:
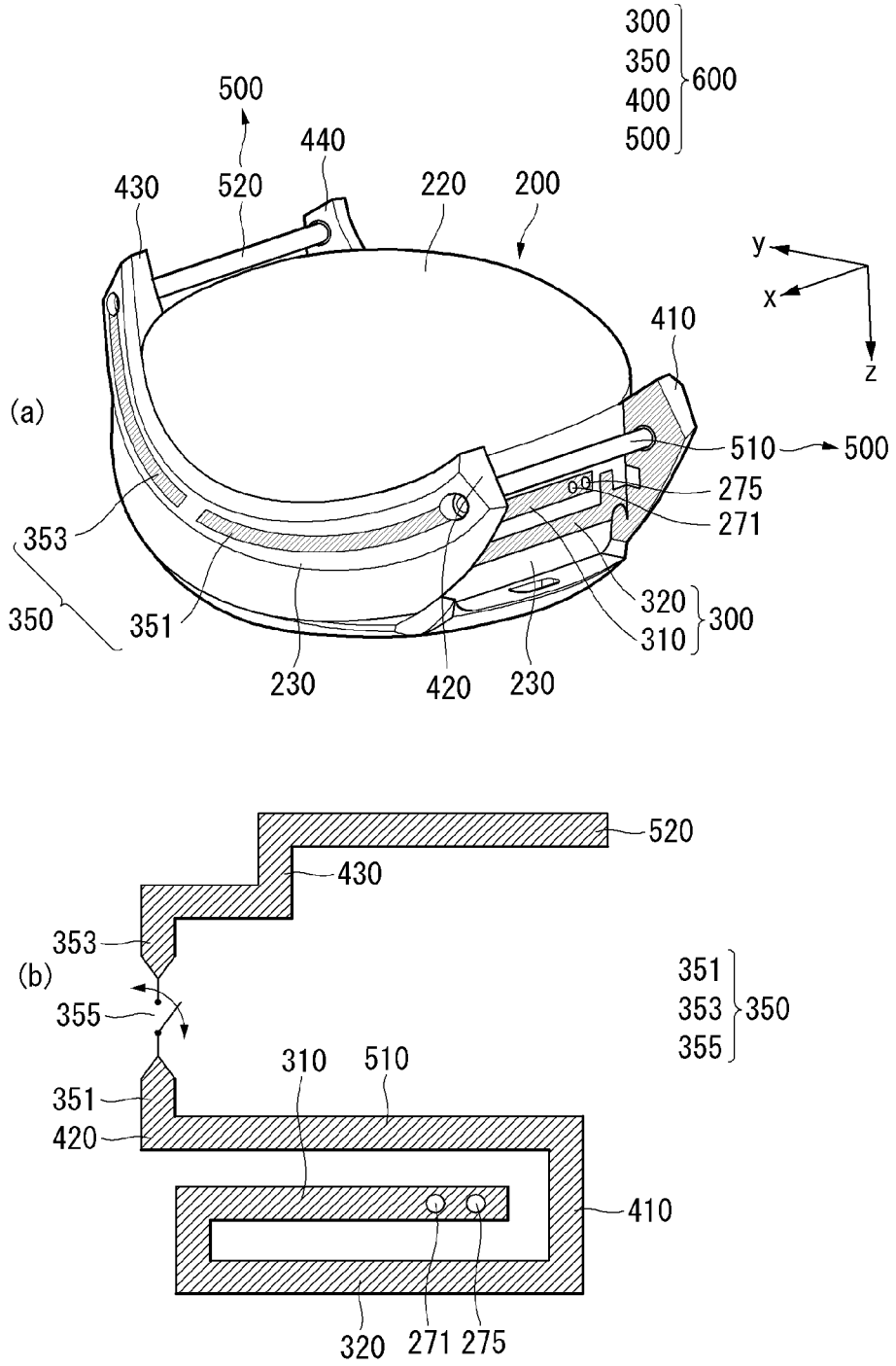

In FIG. 19, (a) illustrates an extended antenna pattern according to the embodiment of the invention, and (b) is a diagram illustrating an electrical connection shown in (a) of FIG. 19.

An electronic device according to the embodiment of the invention shown in FIG. 19 may be different from the electronic device according to the embodiment of the invention shown in FIG. 18 in a configuration of an extended antenna pattern 350 and the controller 180 (see FIG. 1) related to the configuration of the extended antenna pattern 350.

As shown in (a) of FIG. 19, the extended antenna pattern 350 may include a first extended antenna pattern 351 and a second extended antenna pattern 353. The first and second extended antenna patterns 351 and 353 may be formed in an insulating portion of at least one of the side surface 230, the upper surface 210 (see FIG. 7), and the lower surface 220.

As shown in (b) of FIG. 19, the extended antenna pattern 350 may include a pattern switch 355. The pattern switch 355 may be connected to the first extended antenna pattern 351 and the second extended antenna pattern 353 and may perform a switching operation. For example, the pattern switch 355 may be in one state of a first state (i.e., a switch-on state), in which the first extended antenna pattern 351 and the second extended antenna pattern 353 are connected to each other, and a second state (i.e., a switch-off state), in which the first extended antenna pattern 351 and the second extended antenna pattern 353 are separated from each other. The pattern switch 355 may be positioned inside the main body 200. The pattern switch 355 may be mounted on the PCB 240 (see FIG. 8). The pattern switch 355 may be connected to the controller 180 (see FIG. 1).

When the pattern switch 355 is in the second state, an antenna 600 may include an antenna pattern 300, a first strap pin connector 410, a first strap pin 510, a second strap pin connector 420, and the first extended antenna pattern 351. When the pattern switch 355 is in the first state, the antenna 600 may include the antenna pattern 300, the first strap pin connector 410, the first strap pin 510, the second strap pin connector 420, the first extended antenna pattern 351, the second extended antenna pattern 353, a third strap pin connector 430, and a second strap pin 520.

A length of the antenna 600 in the first state of the pattern switch 355 may be longer than a length of the antenna 600 in the second state of the pattern switch 355. In other words, the length of the antenna 600 may vary depending on the switching state of the pattern switch 355. The length of the antenna 600 may depend on a wavelength of radio waves that is transmitted and received. Thus, a frequency band of radio waves may vary by the pattern switch 355.

A plurality of pattern switches 355 may be provided. The pattern switch 355 may be disposed at a location dividing the extended antenna pattern 350 into two. In another embodiment, the pattern switch 355 may be disposed at a location dividing the antenna pattern 300 into two. In another embodiment, the pattern switch 355 may be disposed at a location dividing the antenna pattern 300 and the first strap pin connector 410. Namely, the pattern switch 355 may be disposed at one location of a path for forming the antenna 600 and may be in one of the first state and the second state.

The controller 180 may switch on or off the pattern switch 355 depending on frequencies of electromagnetic wave, that is transmitted and/or received through the antenna 600. The required length of the antenna 600 may vary depending on frequency bands of radio wave that is transmitted and received through the antenna 600. Namely, the controller 180 may switch on or off the pattern switch 355 depending on required frequency bands.

Figure 20:
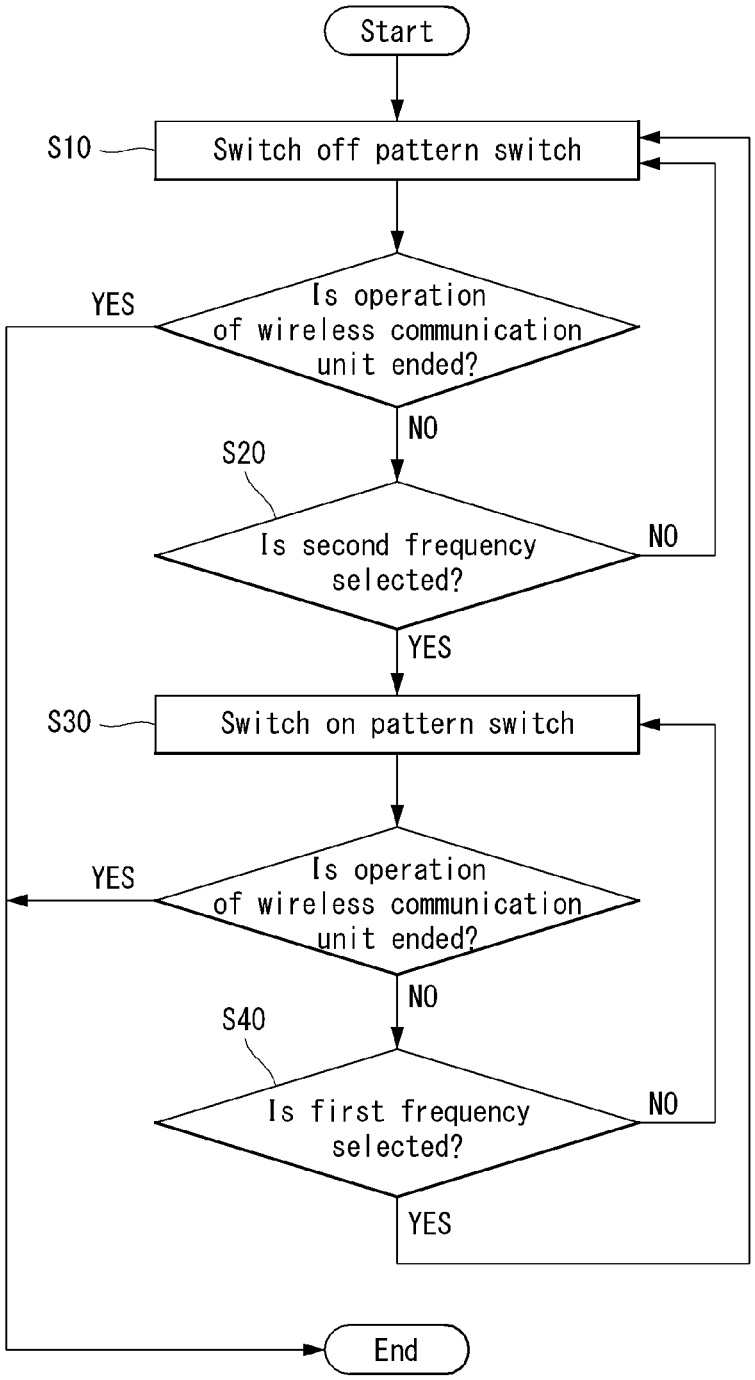
FIG. 20 is a flow chart illustrating a method of operating a pattern switch according to an embodiment of the invention.

FIG. 20 is a flow chart illustrating a method of operating a pattern switch according to the embodiment of the invention.

A method of operating the pattern switch 355 according to the embodiment of the invention may include a step S10 of causing the pattern switch 355 to be in the second state. Namely, the method of operating the pattern switch 355 according to the embodiment of the invention may include the step S10 of switching off the pattern switch 355. An operation of the pattern switch 355 may be controlled by the controller 180. When the pattern switch 355 is in the second state, the antenna 600 may have a length corresponding to a first frequency band.

The method of operating the pattern switch 355 according to the embodiment of the invention may include a step S20 of determining whether or not the use of a second frequency is required for the electronic device. In embodiments disclosed herein, the second frequency may be a frequency of a band different from the first frequency band. When the use of the second frequency is not required for the electronic device, the pattern switch 355 may remain in the second state.

The method of operating the pattern switch 355 according to the embodiment of the invention may include a step S30 of causing the pattern switch 355 to be in the first state. Namely, the method of operating the pattern switch 355 according to the embodiment of the invention may include the step S30 of switching on the pattern switch 355. When the use of the second frequency is required for the electronic device, the pattern switch 355 may be in the first state.

The method of operating the pattern switch 355 according to the embodiment of the invention may include a step S40 of determining whether or not the use of a first frequency is required for the electronic device. When the use of the first frequency is not required for the electronic device, the pattern switch 355 may remain in the first state. When the use of the first frequency is required for the electronic device, the pattern switch 355 may be in the second state.

When the pattern switch 355 is switched on or off or the switching state of the pattern switch 355 is not changed, the embodiment of the invention needs to check whether or not an operation of the wireless communication unit 110 is ended. When the operation of the wireless communication unit 110 is ended, the pattern switch 355 does not need to operate. Thus, an operation of the pattern switch 355 may be ended.

Figure 21:
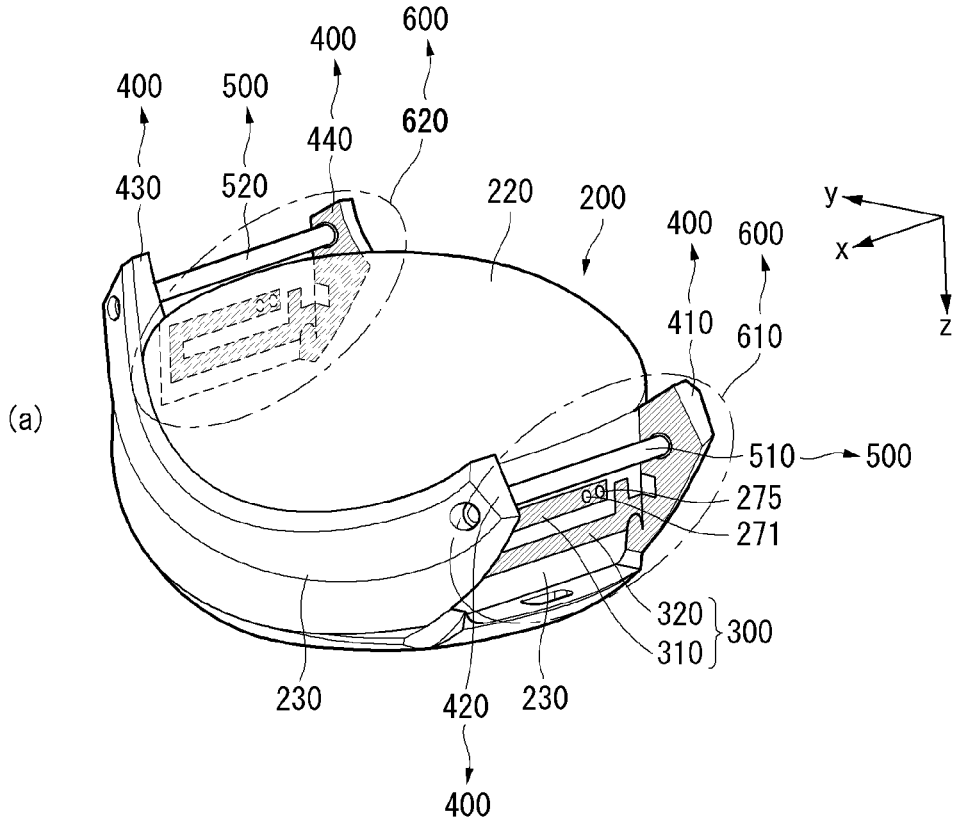
FIGS. 21 and 22 illustrate first and second antennas according to an embodiment of the invention.
Figure 21:
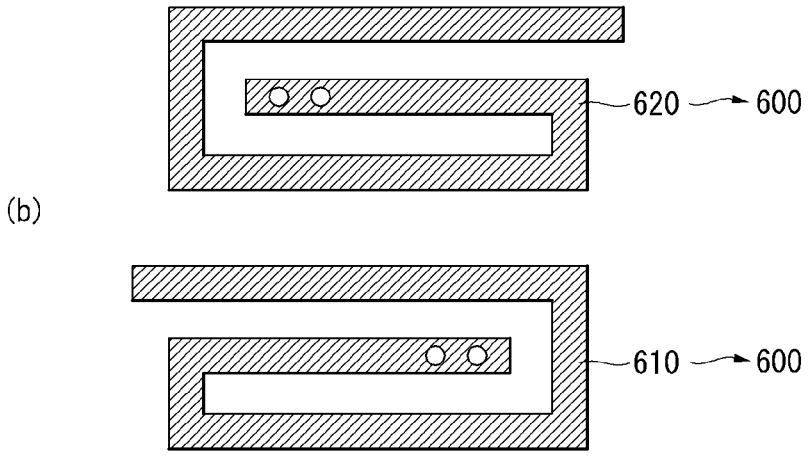

In FIG. 21, (a) illustrates first and second antennas according to the embodiment of the invention, and (b) is a diagram illustrating an electrical connection shown in (a) of FIG. 21.

A plurality of antennas 600 may be provided. For example, the plurality of antennas 600 may include a first antenna 610 and a second antenna 620. The first antenna 610 may include an antenna pattern 300, a first strap pin connector 410, and a first strap pin 510, and the second antenna 620 may include an antenna pattern 300, a fourth strap pin connector 440, and a second strap pin 520.

The first antenna 610 and the second antenna 620 may use different frequency bands. Namely, the first antenna 610 and the second antenna 620 may have different lengths depending on a frequency of radio waves used. The controller 180 may select one of the first antenna 610 and the second antenna 620 depending on a required frequency. Or, the controller 180 may simultaneously operate the first antenna 610 and the second antenna 620.

Figure 22:
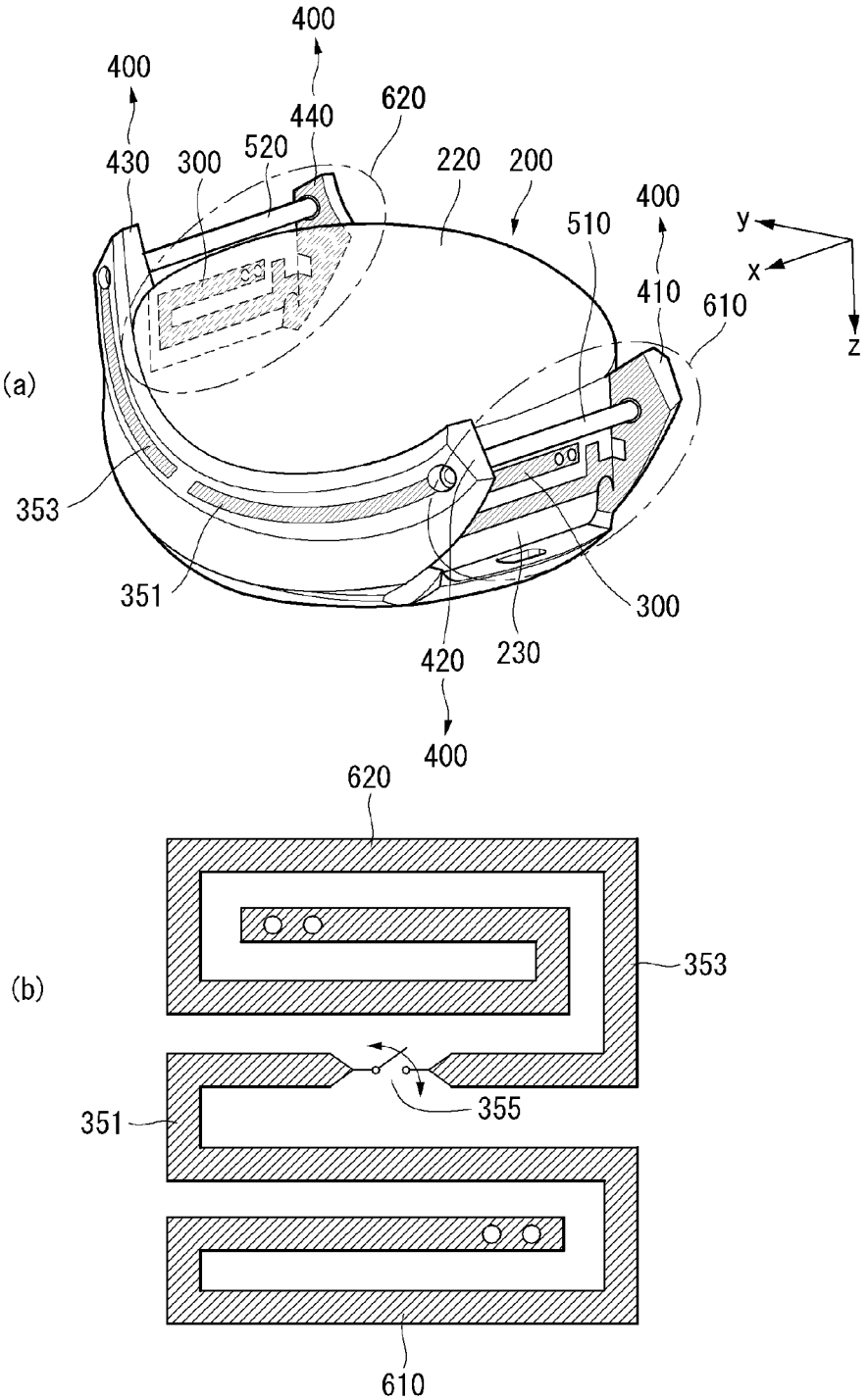

In FIG. 22, (a) illustrates first and second antennas and an extended antenna pattern according to the embodiment of the invention, and (b) is a diagram illustrating an electrical connection shown in (a) of FIG. 22.

Referring to FIG. 22, the electronic device according to the embodiment of the invention may include a first antenna 610, a second antenna 620, and an extended antenna pattern 350. The extended antenna pattern 350 may be formed in an insulating portion of at least one of the side surface 230, the upper surface 210 (see FIG. 7), and the lower surface 220. The extended antenna pattern 350 may include a first extended antenna pattern 351, a second extended antenna pattern 353, and a pattern switch 355.

The first extended antenna pattern 351 may be connected to a second strap pin connector 420, and the second extended antenna pattern 353 may be connected to a third strap pin connector 430. As shown in (b) of FIG. 22, the pattern switch 355 may be connected to the first extended antenna pattern 351 and the second extended antenna pattern 353 and may perform a switching operation. For example, the pattern switch 355 may be in one state of a first state (i.e., a switch-on state), in which the first extended antenna pattern 351 and the second extended antenna pattern 353 are connected to each other, and a second state (i.e., a switch-off state), in which the first extended antenna pattern 351 and the second extended antenna pattern 353 are separated from each other. The pattern switch 355 may be positioned inside the main body 200. The pattern switch 355 may be mounted on the PCB 240 (see FIG. 8). The pattern switch 355 may be connected to the controller 180 (see FIG. 1).

When the pattern switch 355 is in the second state, the first antenna 610 and the second antenna 620 may be electrically separated from each other and may independently operate. When the pattern switch 355 is in the first state, the first antenna 610 and the second antenna 620 may be electrically connected to each other and may operate. When the pattern switch 355 is in the first state, a length of the antenna 600 during an operation may vary. Therefore, a frequency band required in the antenna 600 during the operation may vary. In the first state of the pattern switch 355, the antenna 600 may include two pattern connectors 270. In the first state of the pattern switch 355, if all of the two pattern connectors 270 operate, electrical signals may overlap each other, and the antenna 600 may abnormally operate. Thus, in the first state of the pattern switch 355, only one of the two pattern connectors 270 may operate. For example, when the pattern switch 355 is in the first state, the controller 180 may cause the pattern connector 270 included in the first antenna 610 to operate and the pattern connector 270 included in the second antenna 620 not to operate.

A plurality of pattern switches 355 may be provided. When the plurality of pattern switches 355 is provided, a range of a frequency of radio wave usable in the electronic device according to the embodiment of the invention can be increased. The pattern switch 355 may be disposed at a location dividing the extended antenna pattern 350 into two.

Figure 23:
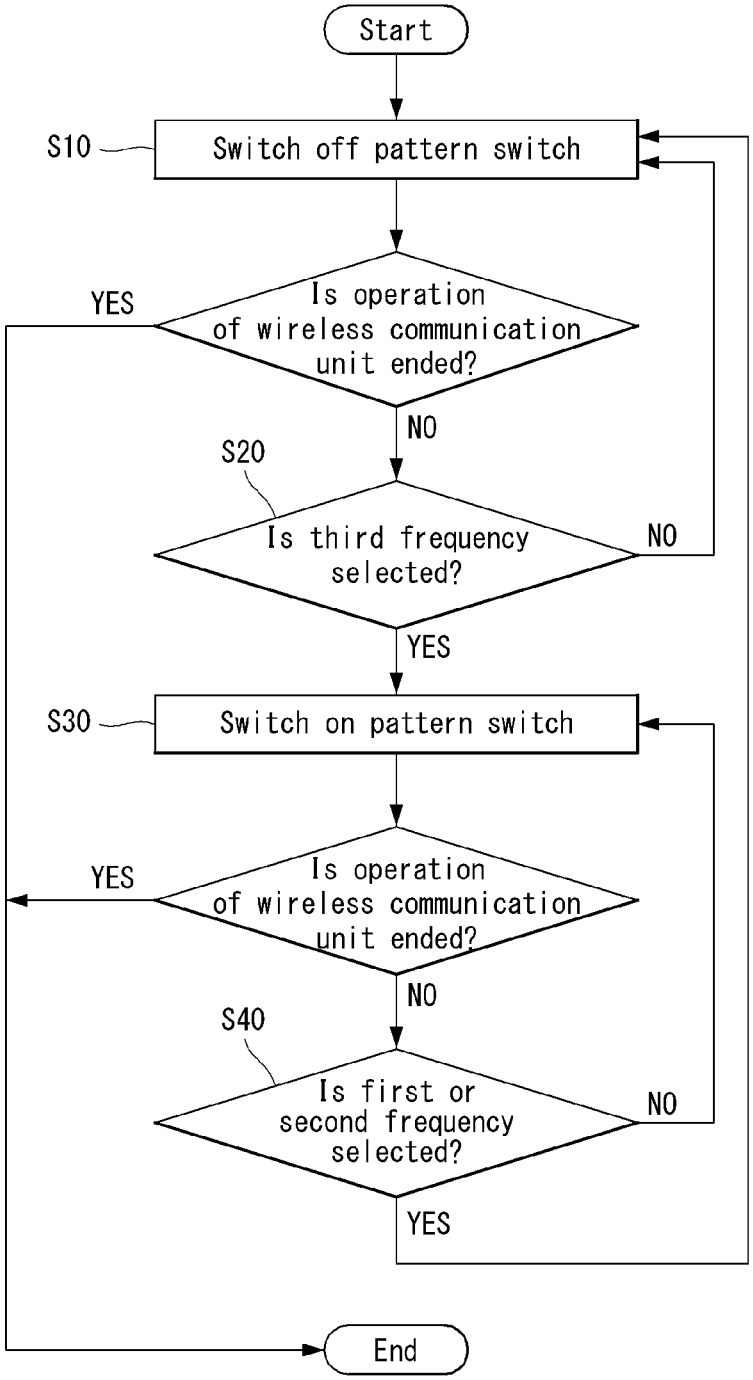
FIG. 23 is a flow chart illustrating a connection of first and second antennas according to an embodiment of the invention.

FIG. 23 is a flow chart illustrating a method of operating a pattern switch connecting first and second antennas according to the embodiment of the invention.

A method of operating the pattern switch 355 connecting first and second antennas according to the embodiment of the invention may include a step S10 of causing the pattern switch 355 to be in the second state. Namely, the method of operating the pattern switch 355 according to the embodiment of the invention may include the step S10 of switching off the pattern switch 355. An operation of the pattern switch 355 may be controlled by the controller 180. When the pattern switch 355 is in the second state, the first antenna 610 may have a length corresponding to a first frequency band, and the second antenna 620 may have a length corresponding to a second frequency band.

The method of operating the pattern switch 355 according to the embodiment of the invention may include a step S20 of determining whether or not the use of a third frequency is required for the electronic device. In embodiments disclosed herein, the third frequency may be a frequency of a band different from the first frequency band and a frequency of a band different from the second frequency band. When the use of the third frequency is not required for the electronic device, the pattern switch 355 may remain in the second state.

The method of operating the pattern switch 355 according to the embodiment of the invention may include a step S30 of causing the pattern switch 355 to be in the first state. Namely, the method of operating the pattern switch 355 according to the embodiment of the invention may include the step S30 of switching on the pattern switch 355. When the use of the third frequency is required for the electronic device, the pattern switch 355 may be in the first state.

The method of operating the pattern switch 355 according to the embodiment of the invention may include a step S40 of determining whether or not the use of a first frequency or a second frequency is required for the electronic device. When the use of the first frequency or the second frequency is not required for the electronic device, the pattern switch 355 may remain in the first state. When the use of the first frequency or the second frequency is required for the electronic device, the pattern switch 355 may be in the second state.

When the pattern switch 355 is switched on or off or the switching state of the pattern switch 355 is not changed, the embodiment of the invention needs to check whether or not an operation of the wireless communication unit 110 is ended. When the operation of the wireless communication unit 110 is ended, the pattern switch 355 does not need to operate. Thus, an operation of the pattern switch 355 may be ended.

Figure 24:
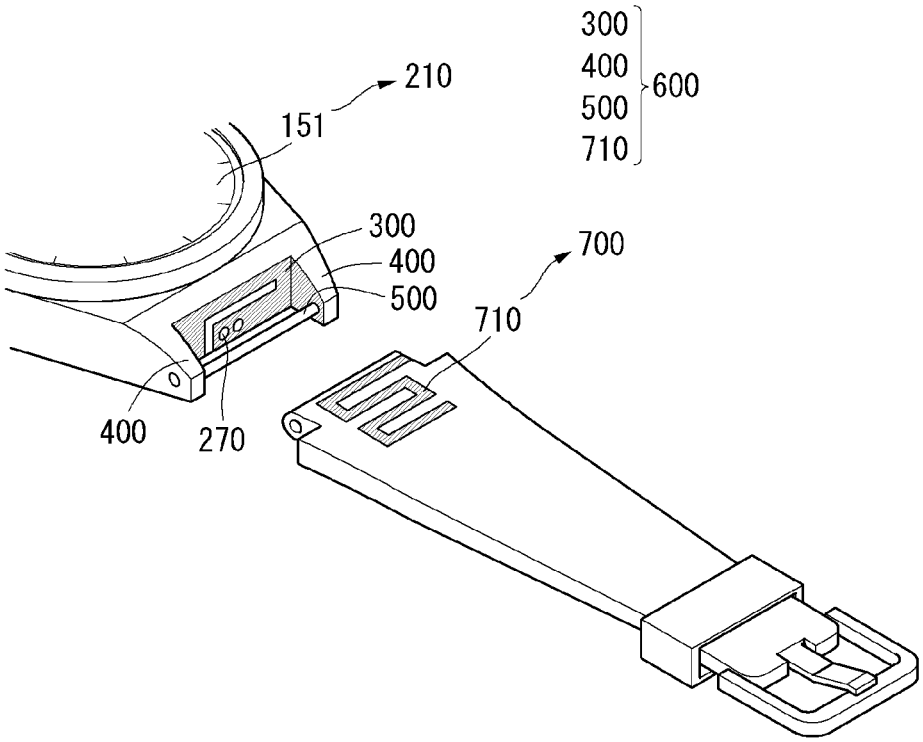
FIG. 24 illustrates a strap pin antenna pattern according to an embodiment of the invention.

FIG. 24 illustrates a strap pin antenna pattern according to the embodiment of the invention.

The electronic device according to the embodiment of the invention may include a strap 700 connected to a strap pin 500. The strap 700 may include a strap antenna pattern 710 with conductivity. The strap antenna pattern 710 may be electrically connected to at least one of a strap pin connector 400 and the strap pin 500.

An antenna pattern 300, the strap pin connector 400, the strap pin 500, and the strap antenna pattern 710 may be electrically connected to one another and may form an antenna 600 that transmits and receives radio waves.

A length of the antenna 600 may vary depending on whether or not the strap antenna pattern 710 is included in the strap 700. Namely, the length of the antenna 600 may be changed by a length of the strap antenna pattern 710. Thus, a frequency used in the electronic device may vary depending on the replacement of the strap 700. When a plurality of strap antenna patterns 710 each having a different length is provided, the strap 700 may be replaced depending on a frequency used in the electronic device.

Figure 25:
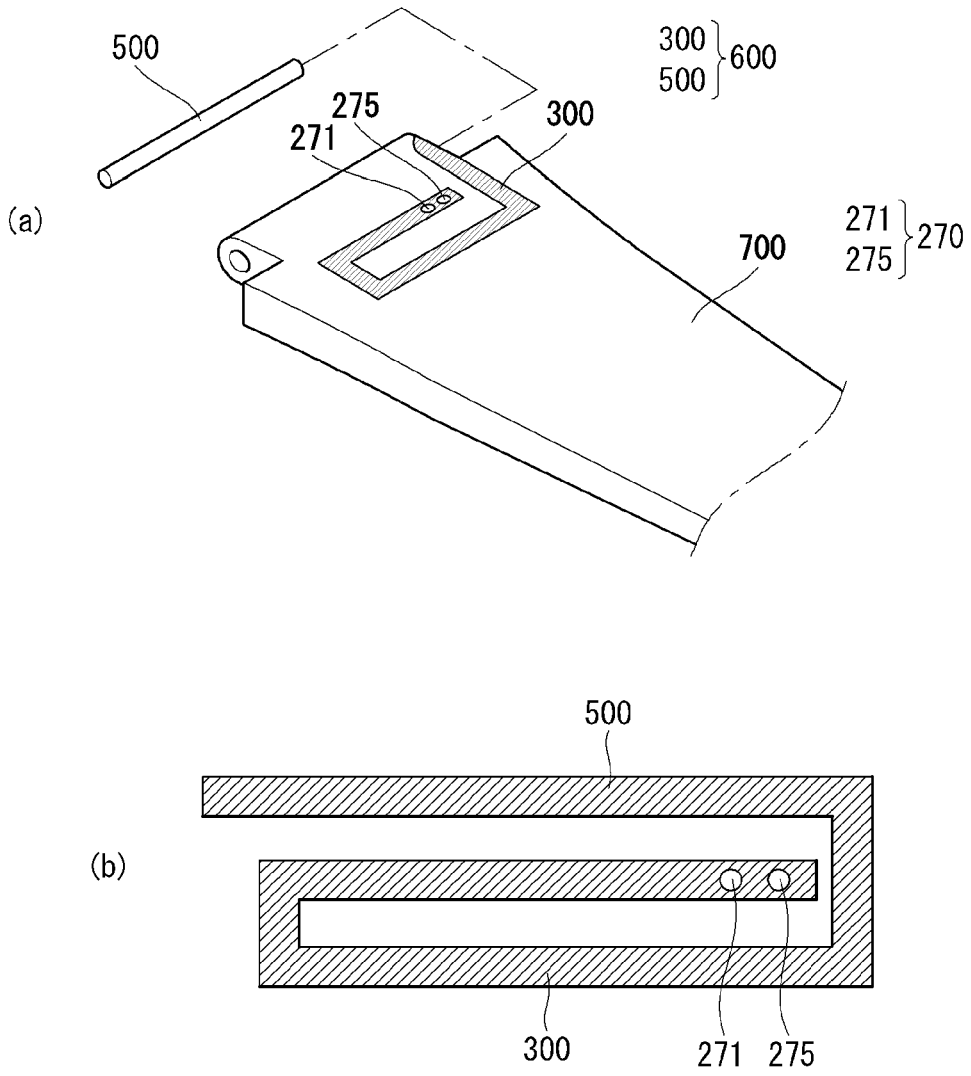
FIG. 25 illustrates an antenna having an antenna pattern formed on a strap in accordance with an embodiment of the invention.

FIG. 25 illustrates an antenna having an antenna pattern formed on a strap in accordance with the embodiment of the invention.

In the electronic device according to the embodiment of the invention, an antenna 600 may include an antenna pattern 300 and a strap pin 500. The antenna pattern 300 may be formed on a strap 700. The antenna pattern 300 may be connected to a pattern connector 270.

The pattern connector 270 may be formed on the strap 700. The pattern connector 270 may transfer an electrical signal to the antenna pattern 300. The electrical signal transferred to the antenna pattern 300 may be transferred to the strap pin 500. At least one of the antenna pattern 300 and the strap pin 500 may receive the electrical signal and transmit radio waves.

The pattern connector 270 and the strap pin 500 may be electrically connected and may form the antenna 600 that transmits and receives the radio waves.

Figure 26:
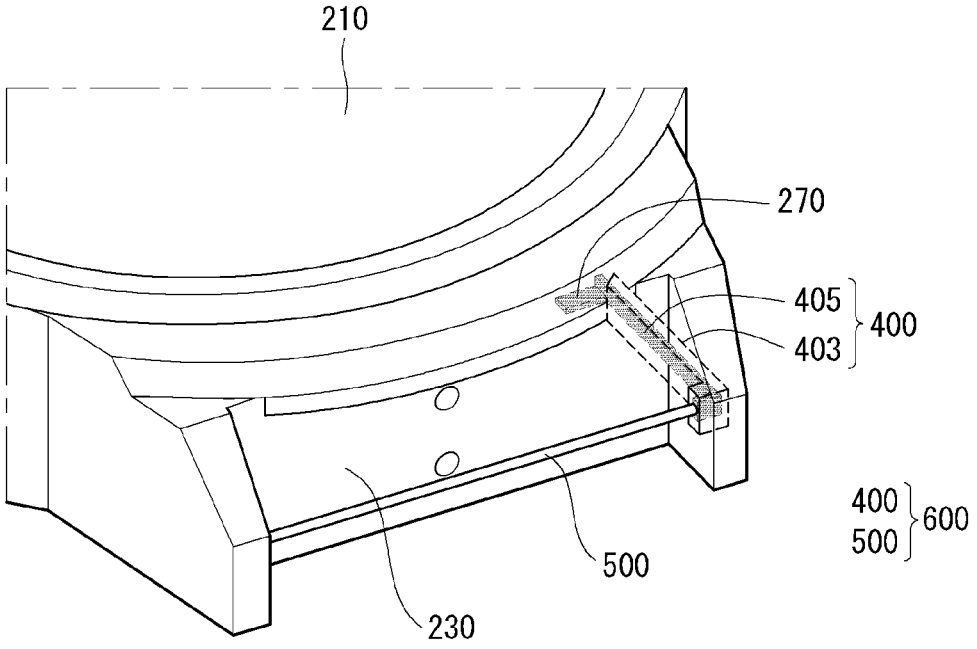
FIG. 26 illustrates an insulating guide hole and a conductive guide included in a strap pin connector in accordance with an embodiment of the invention.

FIG. 26 illustrates an insulating guide hole and a conductive guide included in a strap pin connector in accordance with the embodiment of the invention. An antenna 600 may include a strap pin connector 400 and a strap pin 500.

The strap pin connector 400 according to the embodiment of the invention may be made of metal. The strap pin 500 may be connected to one side of the strap pin connector 400. Namely, when the strap pin connector 400 is entirely made of metal, the strap pin connector 400 and the strap pin 500 may be electrically connected. However, an impedance of the strap pin connector 400 made of metal may excessively increase. Thus, if the strap pin connector 400 made of metal is connected to the strap pin 500, characteristics of the antenna 600 may be degraded.

The strap pin connector 400 may include an insulating guide hole 403 and a conductive guide 405. The insulating guide hole 403 may be made of an electrically insulating material. The insulating guide hole 403 may be positioned inside the strap pin connector 400. The insulating guide hole 403 may have a longitudinal direction protruding from the main body 200. A space may be provided inside the insulating guide hole 403. The conductive guide 405 may be positioned inside the insulating guide hole 403. The conductive guide 405 may be made of a conductive material. The conductive guide 405 may electrically connect the pattern connector 270 to the strap pin 500.

The pattern connector 270 may transfer an electrical signal to the conductive guide 405. The conductive guide 405 may transfer an electrical signal to the strap pin 500. At least one of the conductive guide 405 and the strap pin 500 may convert the transferred electrical signal into radio waves and/or convert the radio waves into an electrical signal by transmitting and receiving the radio waves.

Figure 27:
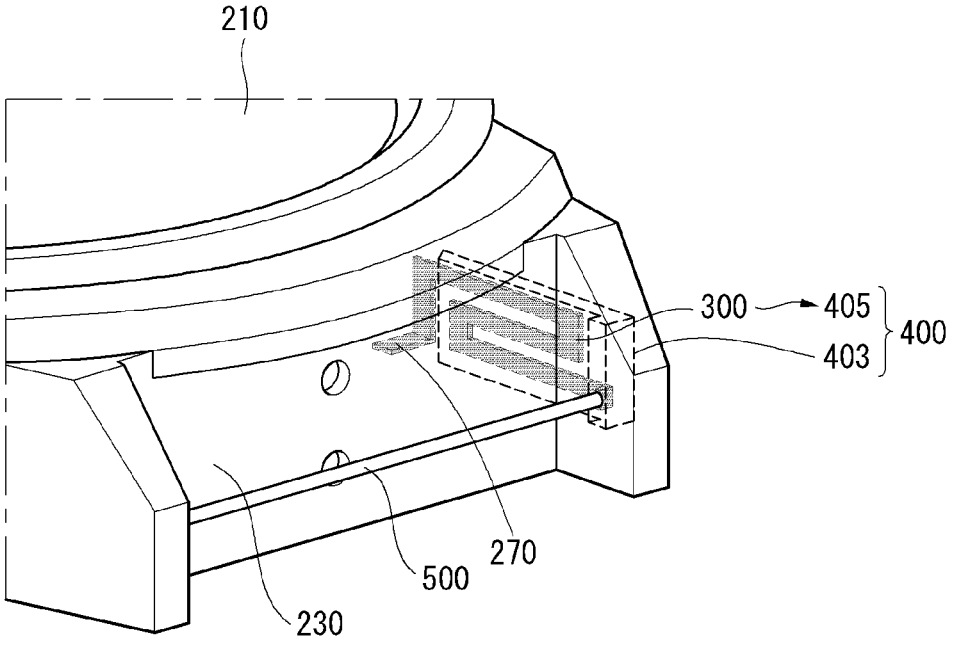
FIG. 27 illustrates an antenna pattern formed on a strap pin connector in accordance with an embodiment of the invention.

FIG. 27 illustrates an antenna pattern formed on a strap pin connector in accordance with to the embodiment of the invention.

A strap pin connector 400 may include an insulating guide hole 403 and a conductive guide 405. At least a portion of the strap pin connector 400 may be made of metal. When at least a portion of the strap pin connector 400 is made of metal, characteristics of an antenna 600 including the strap pin connector 400 may be degraded. Thus, a configuration connecting a strap pin 500 to a pattern connector 270 needs to be separately provided. The insulating guide hole 403 may be made of an insulating material and positioned inside or on one side of the strap pin connector 400. A space may be provided inside the insulating guide hole 403.

The conductive guide 405 may be positioned inside the insulating guide hole 403. The conductive guide 405 may electrically connect the pattern connector 270 to the strap pin 500. When at least a portion of the strap pin connector 400 contacting a formation surface of the insulating guide hole 403 is made of a nonmetallic material, radio waves generated in the conductive guide 405 may be transmitted to the outside. Thus, the conductive guide 405 may be an antenna pattern 300.

Figure 28:
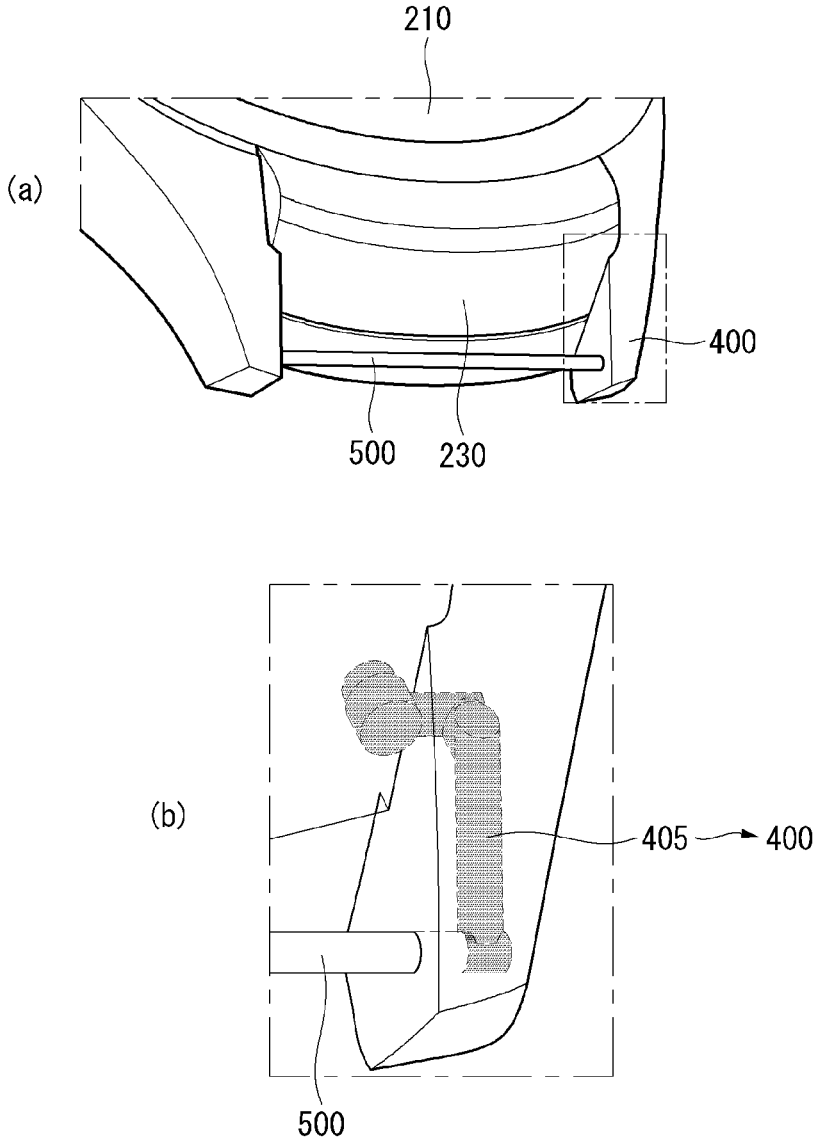
FIG. 28 illustrates a strap pin connector formed through an insert injection molding in accordance with an embodiment of the invention.

In FIG. 28, (a) illustrates a strap pin connector formed through an insert injection molding in accordance with to the embodiment of the invention, and (b) is an enlarged view of a dotted area shown in (a) of FIG. 28.

A strap pin connector 400 according to the embodiment of the invention may be formed by plating a surface with metal and may be electrically connected to a strap pin 500. When the plating processing is performed, the plated metal may disappear by a friction, etc. Therefore, the strap pin connector 400 may be considered to be formed through an insert injection molding.

As shown in FIG. 28, the strap pin connector 400 may be formed through the injection molding in a state where a conductive guide 405 with electrical conductivity is positioned inside the strap pin connector 400. Namely, the conductive guide 405 of the strap pin connector 400 may have the electrical conductivity, but a remaining portion of the strap pin connector 400 except the conductive guide 405 does have the electrical conductivity. As described above, when the strap pin connector 400 is formed through the insert injection molding, durability of the strap pin connector 400 may be improved.

The foregoing embodiments are merely examples and are not to be considered as limiting the present disclosure. The present teachings can be readily applied to other types of methods and apparatuses. The features, structures, methods, and other characteristics of the embodiments described herein may be combined in various ways to obtain additional and/or alternative embodiments.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electronic device comprising:

a main body;

a strap pin connector protruding from the main body, wherein at least a portion of the strap pin connector is conductive;

a strap pin spaced apart from the main body and connected to the strap pin connector, wherein at least a portion of the strap pin is conductive; and an antenna pattern connected to a wireless communication unit, wherein the antenna pattern is conductive, wherein the strap pin includes a first strap pin and a second strap pin, wherein the strap pin connector includes first to fourth strap pin connector, wherein the electronic device further comprises an extended antenna pattern on an outer surface of the main body and the first to fourth strap pin connectors, wherein first and second strap pin connectors are spaced apart from each other and electrically connected to the first strap pin, wherein third and fourth strap pin connectors are spaced apart from each other and electrically connected to the second strap pin, wherein the extended antenna pattern electrically connects the second strap pin connector to the third strap pin connector, and wherein the antenna pattern, the first strap pin connector, the first strap pin, the second strap pin connector, the extended antenna pattern, the third strap pin connector, and the second strap pin are electrically connected to one another and form the antenna that transmits and receives the radio wave.

2. The electronic device of claim 1, wherein the main body includes an upper surface including a display unit, a lower surface opposite and spaced apart from the upper surface, and a side surface connecting the upper surface to the lower surface, wherein the upper surface, the lower surface, and the side surface form a space inside the main body, and wherein at least a portion of the antenna pattern is formed in at least one of an insulating portion of the upper surface, an insulating portion of the lower surface, an insulating portion of the side surface, and an insulating portion of the strap pin connector.

3. The electronic device of claim 1, wherein the antenna pattern includes:

a first antenna pattern portion electrically connected to the wireless communication unit; and a second antenna pattern portion, wherein an end of the second antenna pattern portion is electrically connected to the first antenna pattern portion.

4. The electronic device of claim 3, wherein the main body includes an upper surface including a display unit, a lower surface opposite and spaced apart from the upper surface, and a side surface connecting the upper surface to the lower surface, wherein the upper surface, the lower surface, and the side surface form a space inside the main body, wherein the antenna pattern is formed in an insulating portion of the side surface.

5. The electronic device of claim 1 further comprising a plurality of strap pin connectors protruding from the main body, wherein first and second strap pin connectors are spaced apart from each other and electrically connected to the strap pin, and wherein the antenna pattern includes a first antenna pattern portion connecting the wireless communication unit to the first strap pin connector and a second antenna pattern portion connecting the wireless communication unit to the second strap pin connector and spaced apart from the first antenna pattern portion.

6. The electronic device of claim 1, further comprising a pattern connector mounted on the main body, connecting the wireless communication unit to the antenna pattern, and transmitting and receiving an electrical signal through the antenna pattern, the pattern connector including:

a first antenna feeder connected to the antenna pattern and including a first antenna feeder connector connected to the antenna pattern; and a second antenna feeder connected to the antenna pattern and including a second antenna feeder connector connected to the antenna pattern, wherein the first antenna feeder and the second antenna feeder are connected to one side of the antenna pattern.

7. The electronic device of claim 6, wherein the first antenna feeder connector and the second antenna feeder connector are disposed along a line substantially parallel to the strap pin.

8. The electronic device of claim 1, wherein the extended antenna pattern includes:

a first extended antenna pattern connected to the second strap pin connector;

a second extended antenna pattern connected to the third strap pin connector; and a pattern switch that switches on or off an electrical connection between the first extended antenna pattern and the second extended antenna pattern.

9. The electronic device of claim 8 further comprises a controller that controls the pattern switch depending on a frequency of an electromagnetic wave that is transmitted and received through the antenna.

10. The electronic device of claim 1 further comprising a plurality of antennas, wherein first and second antennas transmit and receive radio waves of different frequencies and are electrically insulated from each other.

11. The electronic device of claim 10 further comprising an extended antenna pattern on the outer surface of the main body, the extended antenna pattern including:

a first extended antenna pattern electrically connected to the first antenna;

a second extended antenna pattern electrically connected to the second antenna; and a pattern switch that switches on or off an electrical connection between the first extended antenna pattern and the second extended antenna pattern.

12. The electronic device of claim 1, wherein the wireless communication unit, the antenna pattern, the strap pin connector, and the strap pin receive an electrical signal in that order to transmit the radio wave.

13. The electronic device of claim 1 further comprising a strap connected to the strap pin, the strap including a conductive strap antenna pattern, wherein at least one of the strap pin connector and the strap pin is electrically connected to the strap antenna pattern, and wherein the strap pin connector, the strap pin, the antenna pattern, and the strap antenna pattern are electrically connected to one another and form the antenna that transmits and receives the radio wave.

14. The electronic device of claim 1, wherein the main body comprises an outer surface, at least a portion of which is insulating, and wherein the antenna pattern is formed on the insulating portion of the outer surface.

15. The electronic device of claim 1, wherein the main body comprises an outer surface, at least a portion of which is insulating, and wherein the antenna pattern is formed in the insulating portion of the outer surface.

* * * * *